US010617251B2

(12) United States Patent
Jessie

(10) Patent No.: US 10,617,251 B2
(45) Date of Patent: Apr. 14, 2020

(54) CURTAIN SYSTEM

(71) Applicant: Debra Leigh Jessie, Speedwell, TN (US)

(72) Inventor: Debra Leigh Jessie, Speedwell, TN (US)

(73) Assignee: Debra Leigh Jessie, Speedwell, TN (US)

( * ) Notice: Subject to any disclaimer, the term of this patent is extended or adjusted under 35 U.S.C. 154(b) by 59 days.

(21) Appl. No.: 15/635,739

(22) Filed: Jun. 28, 2017

(65) Prior Publication Data

US 2019/0000256 A1 Jan. 3, 2019

(51) Int. Cl.

| | |
|---|---|
| ***A47H 23/00*** | (2006.01) |
| ***A47H 1/18*** | (2006.01) |
| ***A47H 23/06*** | (2006.01) |

(52) U.S. Cl.

CPC ..... *A47H 1/18* (2013.01); *A47H 23/00* (2013.01); *A47H 23/06* (2013.01); *A47H 2201/01* (2013.01); *A47H 2201/02* (2013.01)

(58) Field of Classification Search

CPC .. A47H 1/18; A47H 2201/01; A47H 2201/02; A47H 23/00; A47H 1/00; A47H 23/06; A47H 13/14; A47H 13/16; A47H 13/04

See application file for complete search history.

(56) References Cited

U.S. PATENT DOCUMENTS

| | | | | | |
|---|---|---|---|---|---|
| 1,778,499 | A * | 10/1930 | King | A47H 23/02 | 100/297 |
| 2,594,624 | A * | 4/1952 | Dubinsky | A47H 23/02 | 160/123 |
| 2,600,152 | A * | 6/1952 | Blatt | A47K 3/38 | 160/124 |
| 2,608,250 | A * | 8/1952 | Meyer | A47K 3/38 | 160/349.1 |
| 2,840,155 | A * | 6/1958 | Stern | A47H 13/00 | 16/87.2 |
| 4,277,865 | A * | 7/1981 | Takazawa | A47H 13/04 | 160/348 |
| 5,148,580 | A | 9/1992 | Dyckow | | |
| 5,191,922 | A * | 3/1993 | Wade | A47H 13/00 | 160/124 |
| 5,439,042 | A * | 8/1995 | Ohanesian | A47H 1/00 | 160/168.1 R |
| 5,894,642 | A * | 4/1999 | Eberhardt | A47H 13/16 | 160/124 |

(Continued)

FOREIGN PATENT DOCUMENTS

WO 2001074207 A1 10/2001

*Primary Examiner* — Beth A Stephan

(74) *Attorney, Agent, or Firm* — Patterson + Sheridan, LLP

(57) ABSTRACT

A curtain system with improved safety, ease of mounting, ease of dismounting, ease of cleaning, and range of installation is provided herein. The curtain system foregoes the use of a handing rod, and instead is operable to use one or more of a plurality of mounting hardware, including hook and loop fasteners, magnets, and suction mounts. The mounting hardware are selected based on the site of installation of the curtain system, and do not require destructive installation as required for retrofitting a surface with hanging brackets via nails, screws, or adhesive substances such as glues or tapes.

18 Claims, 22 Drawing Sheets

(56) References Cited

U.S. PATENT DOCUMENTS

| | | | | |
|---|---|---|---|---|
| 5,911,265 | A * | 6/1999 | Dreher | A47H 23/04 160/124 |
| 6,038,749 | A * | 3/2000 | Eberhardt | A47H 13/16 16/87.2 |
| 6,163,899 | A * | 12/2000 | Leonard | A47H 23/06 160/330 |
| 6,192,965 | B1 * | 2/2001 | Hinds | A47H 23/00 160/123 |
| 7,165,594 | B2 * | 1/2007 | Senesac | E06B 9/262 160/178.1 V |
| 7,909,082 | B2 * | 3/2011 | Peoples | A47H 2/00 160/123 |
| 2002/0035769 | A1 * | 3/2002 | Huang | A47H 13/04 24/716 |
| 2008/0017328 | A1 * | 1/2008 | Huang | A47H 13/04 160/123 |
| 2008/0173413 | A1 * | 7/2008 | Lam | A47H 1/02 160/348 |
| 2010/0108210 | A1 * | 5/2010 | Salas Garcia | A47H 21/00 150/154 |
| 2011/0168340 | A1 * | 7/2011 | Squillante | A47H 2/00 160/330 |
| 2011/0284172 | A1 * | 11/2011 | Seitz | A47H 13/00 160/123 |
| 2014/0166215 | A1 * | 6/2014 | Thomas | A47H 2/00 160/38 |
| 2014/0251560 | A1 * | 9/2014 | Roth | A47H 1/18 160/330 |
| 2014/0299282 | A1 * | 10/2014 | Fritz | A47H 13/04 160/330 |

* cited by examiner

CURTAIN SYSTEM

INTRODUCTION

Curtains are sections of fabric that are often used in conjunction with windows to improve the aesthetics of the windows, to block or soften light coming through the windows, and/or to provide thermal insulation. Curtains may also be employed to block off areas for privacy, or in conjunction with showers for modesty and keeping water in a designated area, among other uses.

Curtains are often installed via a curtain rail and hang therefrom. These curtain rails include adjustable and fixed length rods as well as tracks from which the curtain may directly hang or hang via a series of hangers connecting the curtain and the curtain rail. The mounting hardware for curtain rails often requires destructive means of affixing the rail to a surface, such as nails, screws, glues, or tapes, which may damage a finish of the surface or damage the underlying structure thereof. Other means for mounting curtail rails include springs in a tension rod, which can leave marks on the mounting surfaces, and degrade in strength over time, leaving the curtain in danger of falling from its mount.

SUMMARY

Aspects of the present disclosure provide for a curtain system. A presently described curtain system does not require the use of a curtain rail, which provides for improved ease of installation, less damage to mounting surfaces, greater numbers of surfaces from which curtains may be mounted, greater ease of cleaning, improved safety, reduced cost, among other advantages over curtains using curtain rails that will be apparent from a review of the detailed description and drawings.

Mounting hardware for the present curtain system is integrated at least in part with the curtain system. In various aspects, mounting hardware includes magnets, hook-and-loop fasteners, suction cups, hooks, buttons, through holes, and combinations thereof integrated with the body of the curtain system or connected to the mounting surface. The mounting hardware integrated with the body of the curtain system may be selectively removed (and later reintegrated) to aid in washing the body of the curtain system.

Details of several example aspects are set for in the accompanying drawings and detailed description below. It will be understood that the following detailed description is explanatory only and is not restrictive of the present disclosure. One of ordinary skill in the art will appreciate several features and advantages of the present curtain system from reviewing the detailed description and drawings.

BRIEF DESCRIPTION OF THE DRAWINGS

The following drawings illustrate various features, aspects, and advantages of the present disclosure, at least some of which are discussed in the detailed description. Elements are not to scale so as to more clearly illustrate details, and like elements are shown with like reference numbers throughout the several illustrations, wherein.

DETAILED DESCRIPTION

The following detailed description is provided in relation to the drawings to highlight various examples and aspects, but other implementations, modifications, and adaptations are possible. Accordingly, the detailed description does not limit the scope of the present disclosure, but rather, the proper scope is defined by the appended claims.

The presently described curtain system does not require the use of a curtain rail, which provides for improved ease of installation, less damage to mounting surfaces, greater numbers of surfaces from which curtains may be mounted, greater ease of cleaning, improved safety, reduced cost, among other advantages over curtains using curtain rails that will be apparent from a review of the detailed description and drawings.

As used herein, directional terms (e.g., upward, upper, downward, lower, right, left) shall be used in regard to an installed system unless noted otherwise. As will be appreciated, the "face" or "rear" of a curtain are opposite sides of the curtain, that are defined by the rear's integration of mounting hardware and not a user's perspective of the installed system. The length of items shall refer to a vertical dimension of the system as measured from the installed position, and the width shall refer to a horizontal dimension as measured from the installed position unless noted otherwise or clear from the context.

Figure 1A:
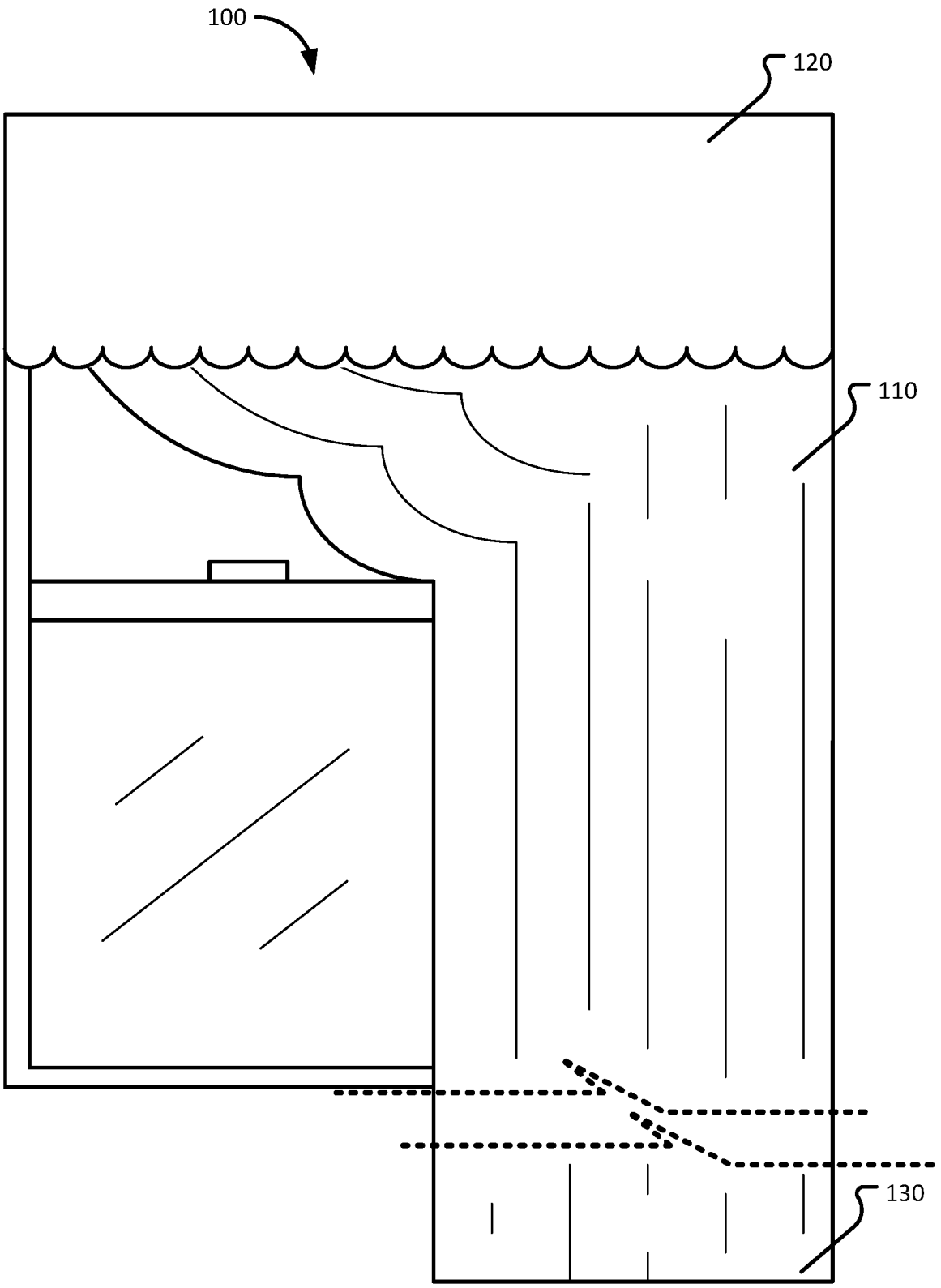
FIG. 1A illustrates a front view of an installed curtain system.

FIG. 1A illustrates a front view of curtain system 100 installed in a window frame. As will be appreciated, a curtain system 100 as described herein may be installed in a variety of locations including on doors, windows, boat hulls, bathtubs, shower stalls, in the middle of a room, at an entryway of the room, etc., and FIG. 1A provides but one installation option.

The front view of the curtain system 100 illustrates several features of the curtain system 100. The curtain body 110 is made from any type of fabric, including, but not limited to: cotton, flax, hemp, silk, wool, leather, nylon, polyester, vinyl, etc., and may incorporate a decorative pattern on one or more faces of the fabric. The fabric that the curtain body 110 is made from may be a textile in one of various weaves. For example, a diaphanous curtain body 110 uses a loose or lacy weave to allow light through as a sheer curtain, whereas a "blackout" curtain body 110 uses a thicker weave to block light. In various aspects, the curtain body 110 incorporates several layers of fabrics, for example, to include a first layer with an aesthetically pleasing pattern but poor light blocking properties with a second layer with superior light blocking properties but poor aesthetics to produce an aesthetically pleasing curtain system 100 with superior light blocking properties.

The curtain body 110 includes various mounting hardware and hardware integrators to enable the curtain system 100 to be mounted without the use of a curtain rail. These mounting hardware and hardware integrators are hidden in the front view of the curtain system 100 illustrated in FIG. 1A, and are discussed in greater detail in regard to FIGS. 1B, 3A-D, 4A-C, and 5A-G.

In various aspects, the curtain system 100 includes an optional valance 120. The valance 120 runs for at least the width of the curtain body 110, and no longer than the length of the curtain body 110. In one example, the valance 120 is connected to the curtain body 110 via stitching, fabric glue, or being constructed from the same piece of fabric as the curtain body 110. In other aspects, the curtain system 100 includes two curtain bodies 110, with a shorter curtain body 110 mounted at the top of and/or above a longer curtain body 110 to act as a detachable valance 120. The presence of an optional valance 120 provides a user of the curtain system 100 additional aesthetic options, the ability to "loop" additional fabric to avoid dragging the excess on the ground or outside of a mounting frame, the ability to adjust upper and lower portions of a curtain system 100 separately from one another, etc.

In various aspects, the curtain system 100 includes a free-hanging section 130 that is not mounted to a surface, but hangs freely. In one example the free-hanging section 130 is a portion of the curtain body 110 from which the mounting hardware has been removed or is otherwise allowed to hang free (e.g., not mounted to a surface in the current configuration). In a second example, the free-hanging section 130 is a portion of the curtain system 100 extending from the curtain body 110 that does not incorporate hardware integrators or mounting hardware (e.g., not mountable to a surface). In a third example, the free-hanging section 130 is an additional piece of fabric attached to the lower edge of the curtain body 110. Although one length of a free-hanging section 130 is shown in FIG. 1A, one of ordinary skill in the art will appreciate that the length of the free-hanging section 130 may differ from that shown, and that the ratio of lengths between the curtain body 110 mounted to a given surface and the free-hanging section 130 may also vary.

Figure 1B:
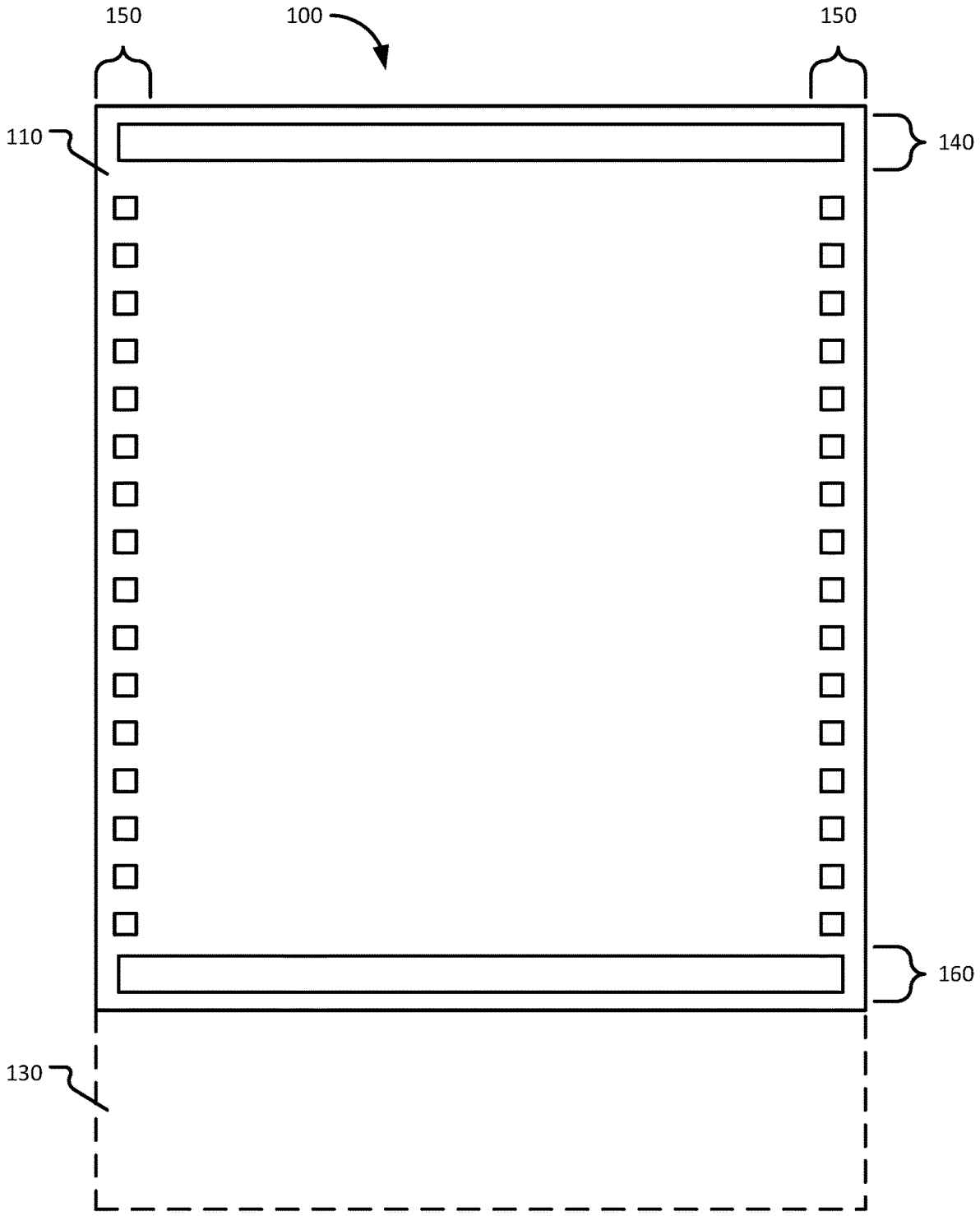
FIG. 1B illustrates a rear view of a curtain system.

FIG. 1B illustrates a rear view of a curtain system 100—showing an example obverse of an uninstalled curtain system 100 with various mounting portions of the curtain system 100 highlighted. Although shown with a rectangular piece of fabric with straight edges in FIG. 1B, the curtain system 100 may include various shapes and edges including dovetails, fringe, tassels, scalloping, crenellations, etc. As will also be appreciated, because the valance 120 is positioned in front of the face of the curtain body 110, no valance 120 is shown in FIG. 1B, although one may optionally be included with the curtain system 100 illustrated herein.

The rear of the curtain system 100 includes several areas in which mounting hardware may be incorporated, either by direct integration with the curtain body 110 or integration via hardware integrators that allow for the removal and reintegration of mounting hardware. Direct integration of mounting hardware includes, but is not limited to: the sewing on, gluing on, or construction from hook-and-loop fasteners; the construction of button-holes or hook catches, with and without the integration of grommets or reinforced stitching; the permanent incorporation of magnets into the fabric; and the like to the curtain body 110. Hardware integrators may similarly be constructed into or affixed onto the curtain body 110, and several examples are discussed in greater detail in regard to FIGS. 3A-D and 4A-C.

The areas of integration are generally described herein as: a top mounting area 140, running horizontally along the uppermost edge of the curtain body 110 when the curtain system 100 is installed; side mounting areas 150, running vertically along the side edges of the curtain body 110 when the curtain system is installed; and a lower mounting area 160, running horizontally along the lowermost edge of the curtain body 110 when the curtain system 100 is installed. In various aspects, the side mounting areas 150 may run only partially along the vertical length of the curtain system 100, allowing for lengths of the curtain to hang freely. Similarly, the lower mounting area 160 may be positioned at the border of the curtain body 110 and the free-hanging section 130, or may be omitted. In some aspects, the curtain system 100 includes only one side mounting area 140, or only incorporates mounting hardware into one side mounting area 140. In other aspects, other vertically running or horizontally running mounting areas are optionally included in the curtain body 110.

Figure 2A:
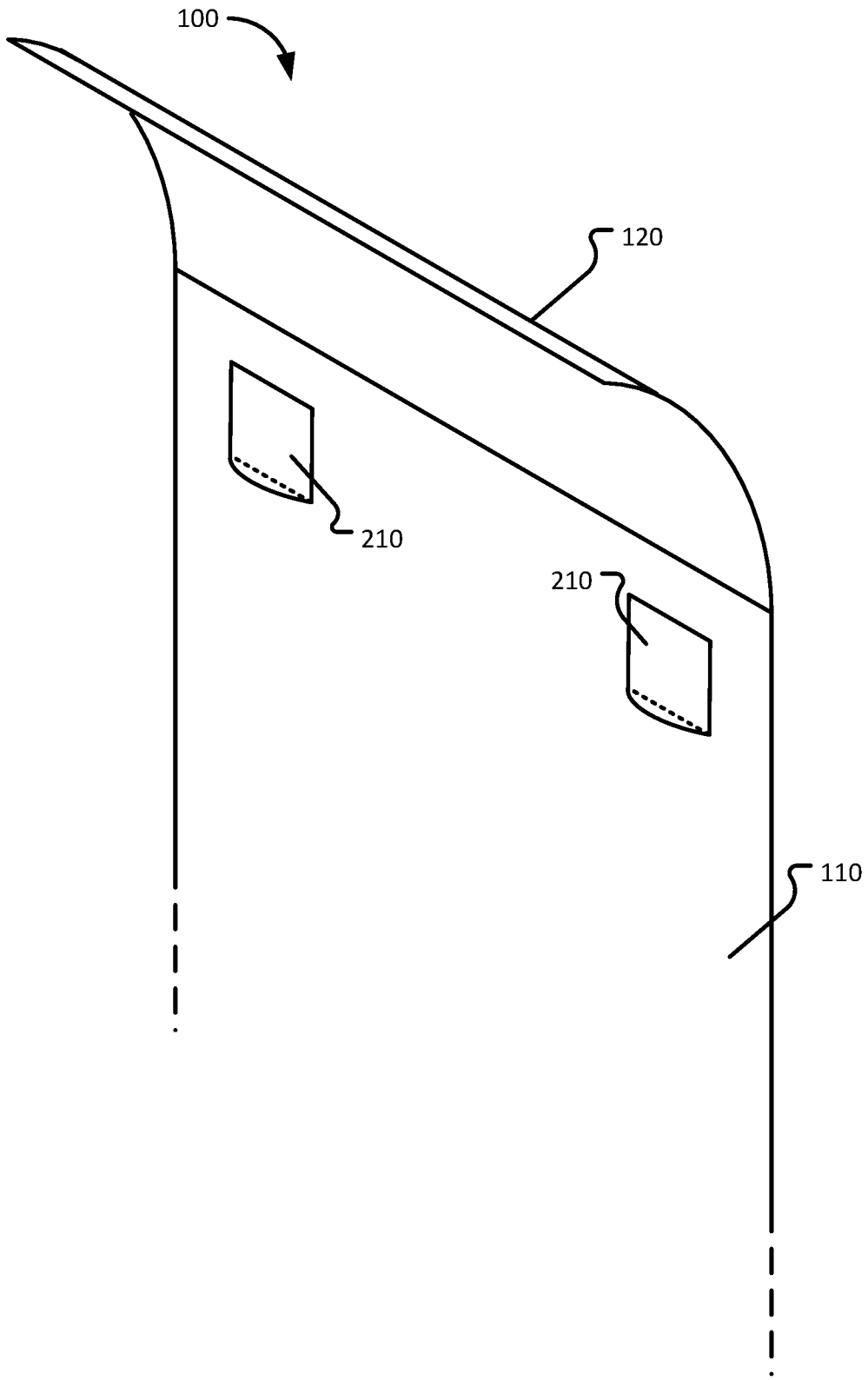
FIGS. 2A-C illustrate installation brackets for use with the curtain system.

FIG. 2A illustrates an optional installation bracket 210 installed on the face of the curtain body 110. In various aspects, one or more installation brackets 210 are located on the face of the curtain body 110 in an area corresponding to the overhang of an optional valance 120, thus hiding the installation bracket 210 from view when the curtain system 100 is installed with a valance 120. In FIG. 2A, the optional valance 120 is shown lifted out of position to better illustrate two installation brackets 210. The installation bracket 210 defines a pocket with a downward facing opening (e.g., opening towards the lower edge of the curtain system 100) into which a dowel or rod (e.g., a broom handle) may be inserted to thereby push the upper portion of the curtain body 110 into an installed position. In various aspects, one installation bracket 210 is located at a left-most edge of the curtain body 110 and one at a right-most edge of the curtain body 110; several installation brackets 210 are located along the width of the curtain body 110 periodically (e.g., every x inches); or one installation bracket 210 runs the width of the curtain body 110.

For example, with a magnetically mounted curtain system 100, the mounting magnets at the top mounting area 140 may be mounted to a ferrous surface below their final installation point (e.g., on a lower portion of a metallic window/door frame) and a user may slide the curtain body 110 into its final installation point (e.g., the top of a metallic window/door frame), pushing the curtain upward. In this way, a user may install the described curtain system 100 into a window or doorframe beyond the user's normal reach by raising the upper portion of the curtain system 100 on the surface to which it mounts via the inserted dowel/rod and installation bracket 210.

Figure 2B:
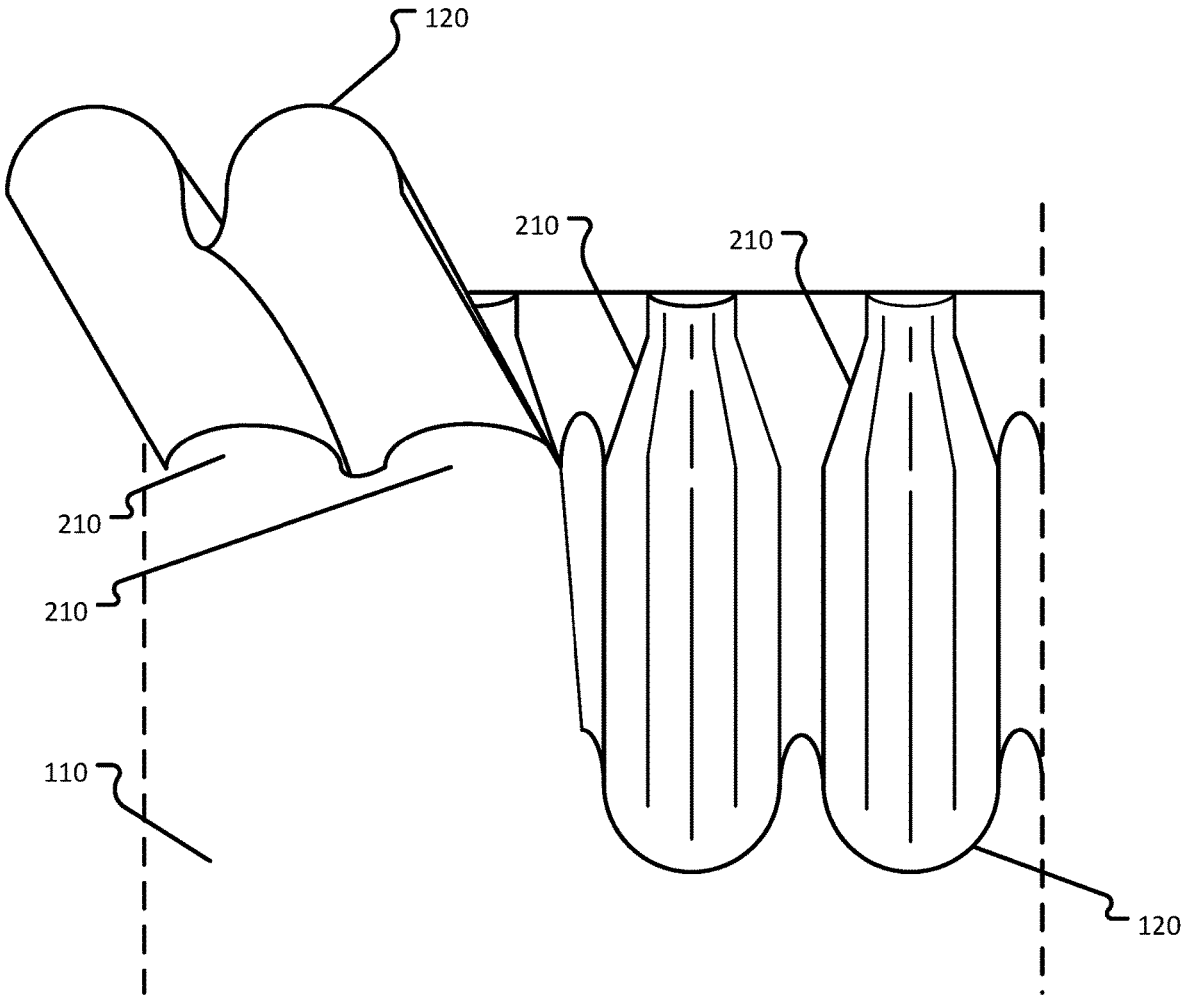

FIG. 2B illustrates a second construction of an installation bracket 210, defined between the curtain body 110 and the valance 120. In the illustration, the valance 120 is connected to the curtain body 110 to define pleats that are open from below to accept a rod or dowel. For ease of illustration, two pleats of the valance 120 are shown as raised from the curtain body 110 and two are shown as lowered, to more clearly illustrate the defined installation brackets 210. In the second construction, the valance 120 is connected to the curtain body 110 at set intervals along the width of the curtain body 110 to define several installation brackets 210 via loops in the fabric of the pleated valance 120. As illustrated, some of the loops are open at the top to allow for excess fabric to be gathered at the installation bracket 210, but with a smaller opening than the lower opening so that the installation bracket 210 can accept the rod or dowel, but also capture it. In other aspects some or all of the loops are closed and do not possess an upper opening.

Figure 2C:
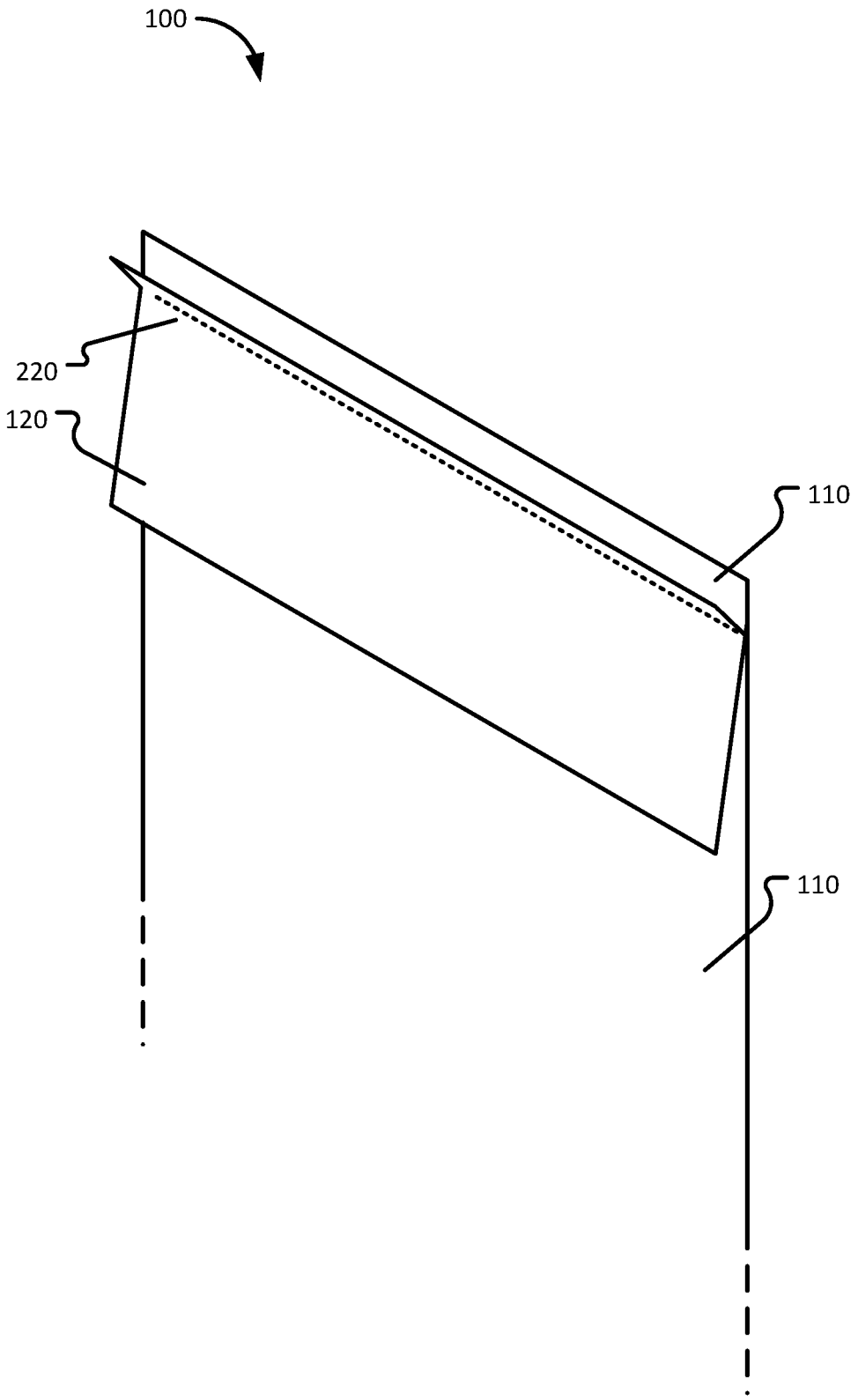

FIG. 2C illustrates a third construction of an installation bracket 210, defined between the curtain body 110 and the valance 120. In the illustration, the valance 120 is connected to the curtain body 110 via a seam 220 (shown with a dotted line) joining the curtain body 110 and valance 120, which is operable to capture a rod or dowel; the seam 220 acts as the installation bracket 210. In various aspects, the seam 220 runs parallel to the upper edge of the curtain body 110, while in other aspects, the seam 220 is curvilineal (with concavities directed downward from the upper edge of the curtain body 110) or a bracket (with downward projecting seams) to engage the rod or dowel.

The inclusion of installation brackets 210 increases the safety of installation of the curtain system 100 by obviating the need for using a ladder, step-stool, or chair for users whose normal reach is below the upper mounting position of a desired curtain, and improves accessibility and functionality for persons bound to a wheelchairs, afraid of heights, etc.

FIGS. 3A-D illustrate several examples of hardware integrators that include various pockets mounted to the curtain body 110. Each of the illustrated pockets defines a cavity into which mounting hardware is placed to secure the curtain body 110 (at least partially) to a mounting surface or another piece of mounting hardware that is secured against a surface. For example, a magnet may be placed into the cavity to secure the curtain body 100 magnetically against a ferrous surface or a counter-polar magnet attached to the mounting surface. In another example, a button or hook may extend through a hole defined by the pocket and project into its cavity, thereby securing the curtain body against the button or hook mounting hardware that is attached to the mounting surface. In several aspects, a plurality of hardware integrators as described in FIGS. 3A-D are included in one or more of the top mounting area 140, side mounting area(s) 150, and/or lower mounting area 160.

Figure 3A:
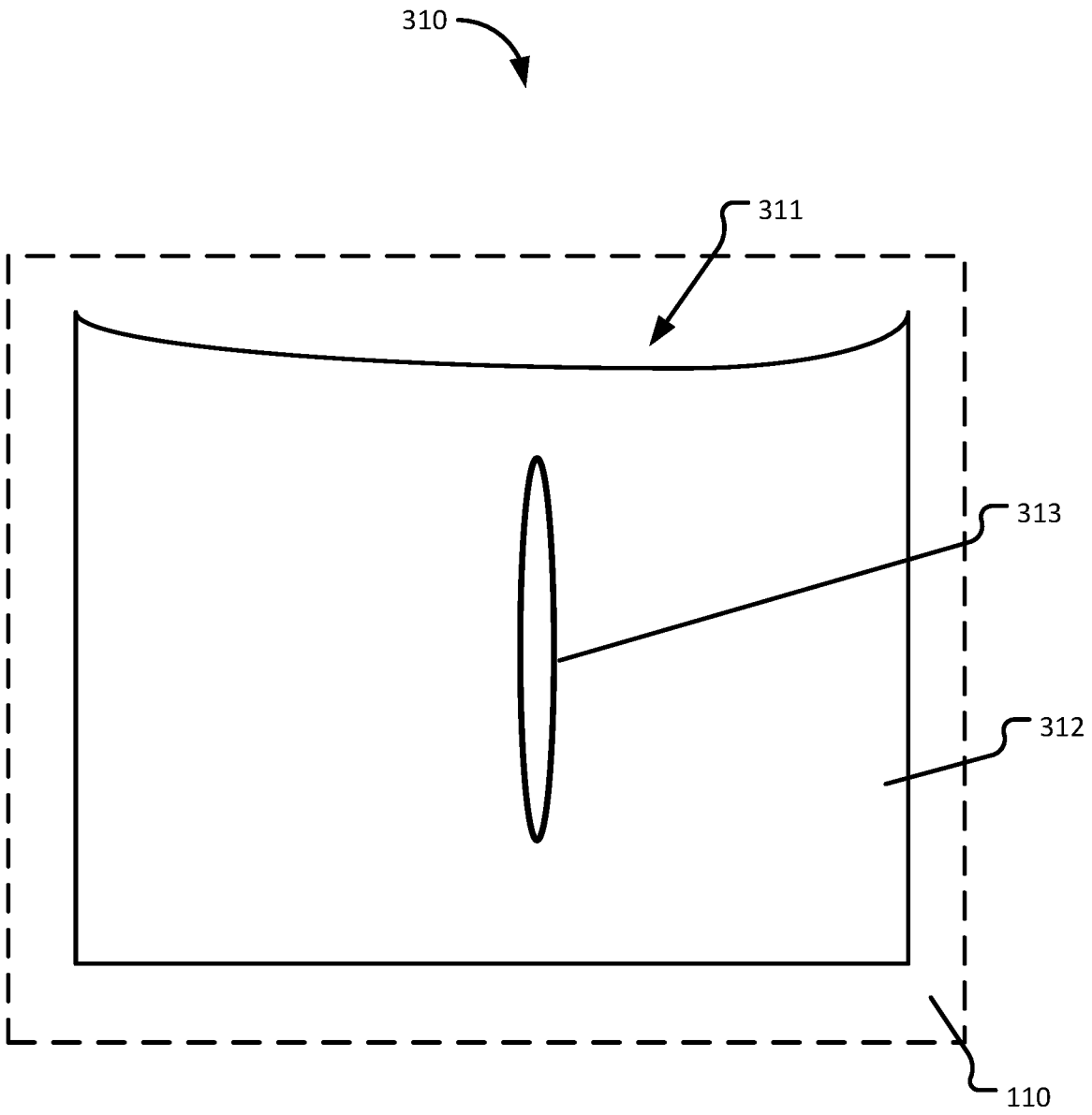
FIGS. 3A-D illustrate examples of hardware integrators.

Each of the pockets illustrated includes at least one opening 311 to accept and capture a mounting hardware element and allow for its removal when the curtain system 100 is not installed (e.g., for laundering the curtain system 100). At least one pocket face 312 is mounted (e.g., sewed, glued) to the rear of the curtain body 110 to define the opening 311. In various aspects, the pocket face 312 is made from a mesh or lighter fabric than the fabric of the curtain body 110. Similarly, in other aspects, the pocket face 312 is made from a hook-and-loop fastener material to engage with the mounting surface to thereby mount the curtain body 110 to that surface. As illustrated in FIG. 3A, the pocket face 312 defines an optional button hole 313 into which a hook or button may project into the open pocket 310 and thereby engage the pocket for mounting the curtain body 110. Although the pockets in FIGS. 3A-D are illustrated as generally rectangular, other shapes are possible, including, but not limited to: circular, hexagonal, triangular, and irregularly shaped pockets.

FIG. 3A illustrates an example pocket with an open cavity 310. In some aspects, the pocket with an open cavity 310 secures magnets (if used) via gravity against one or more of the surfaces of the pocket face 312 connected to the curtain body 110, and positions the opening 311 such that the magnet will not fall out while the curtain system 100 is installed. In some aspects, the opening 311 is directed at 90 degrees (i.e., facing upward) relative to the installed position of the curtain system 100. In other aspects, the angle at which the opening 311 is directed may vary from 0 to 180 degrees (i.e., facing anywhere from leftward to rightward and the diagonal-upwards orientations between).

Figure 3B:
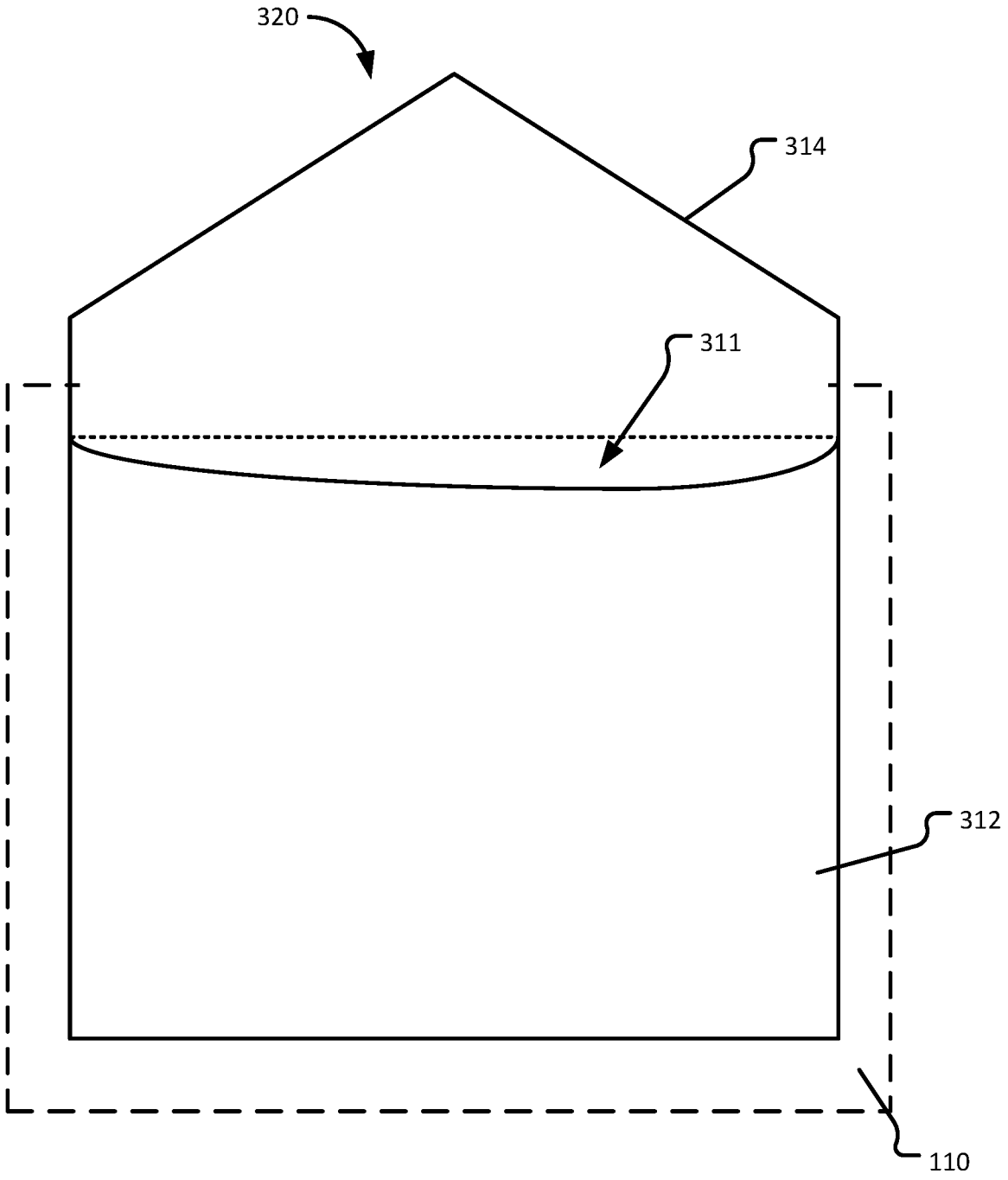

FIG. 3B illustrates an example pocket with closure flap 320 to secure the opening 311 into which a magnet may be placed. The closure flap 314 is shown in FIG. 3B in the upward position, to enable the insertion or removal of mounting hardware into the pocket. In various aspects, the closure flap 314 is secured against the pocket face 312 or curtain body 110 via a snap, button, or hook-and-loop fastener to prevent the mounting hardware from falling out of the cavity, but allowing for the removal of the mounting hardware (e.g., to clean the curtain system 100 or convert a portion of the curtain system 100 into a free-hanging section 130). In aspects that include a closure flap 314, the closure flap 314 may be a separate piece of fabric attached to the curtain body 110 or the pocket may be formed in one piece of fabric secured to the curtain body 100 by looping the pocket face 312 back on itself to define the walls of the pocket and define the opening 311 with additional unattached fabric forming the closure flap 314.

Figure 3C:
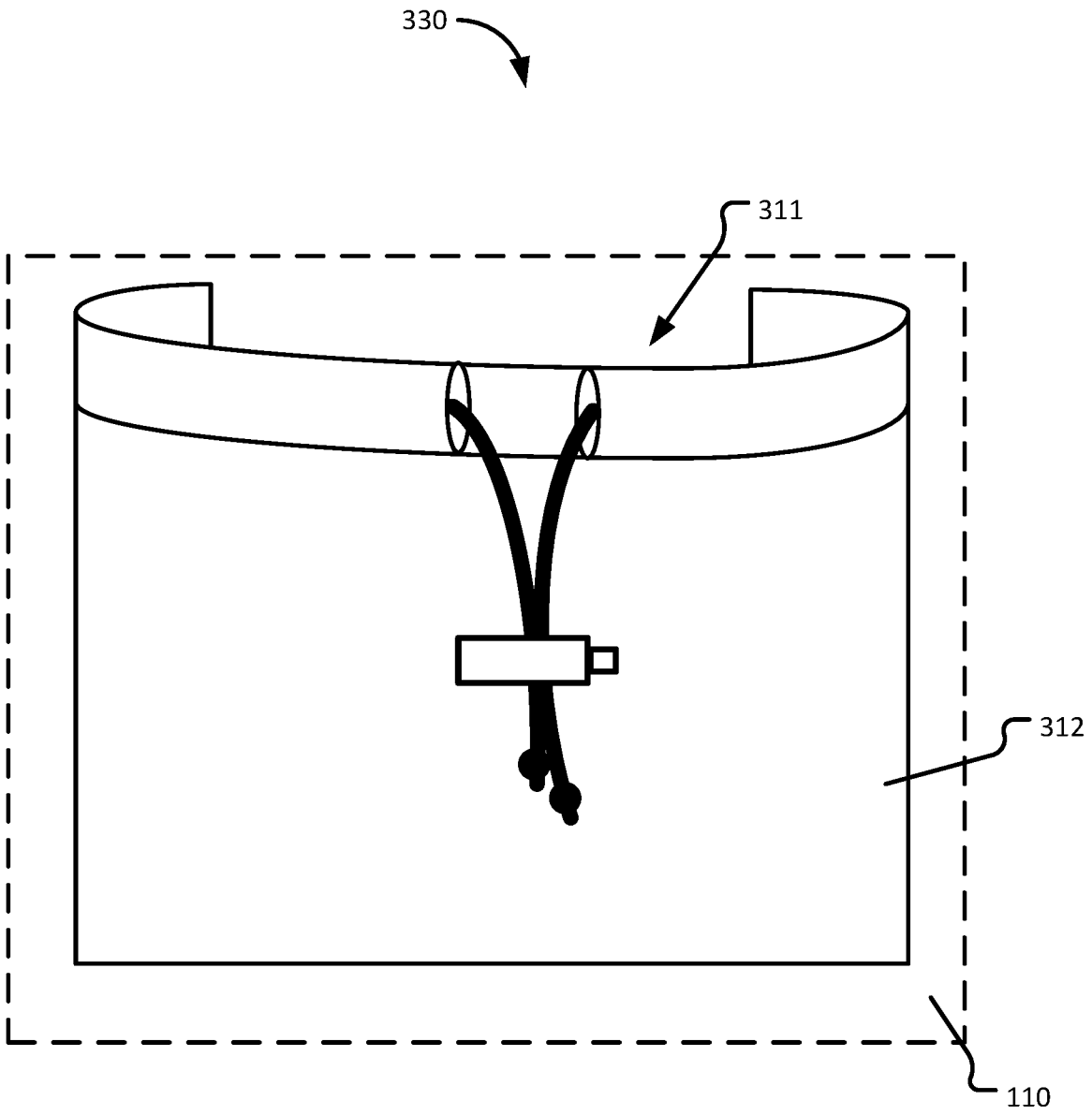

FIG. 3C illustrates an example pocket with drawstring closure 330. Excess material at the opening 311 allows for the insertion of mounting hardware into the pocket, and the excess material is drawn up by the connected drawstring closure 330. The drawstring closure 330 includes a string or cord attached one or more of the distal edges of the opening 311, such that when the string or cord is pulled, the opening 311 is closed or reduced in cross-sectional area by gathering up the excess material to capture the mounting hardware in the pocket. Various string securing means may be used to keep the drawstring closure 330 in a closed position to secure the magnet in the pocket, including, but not limited to: excess string in which a knot has been tied, cordlocks, clamps, buckles, and ladder locks.

Figure 3D:
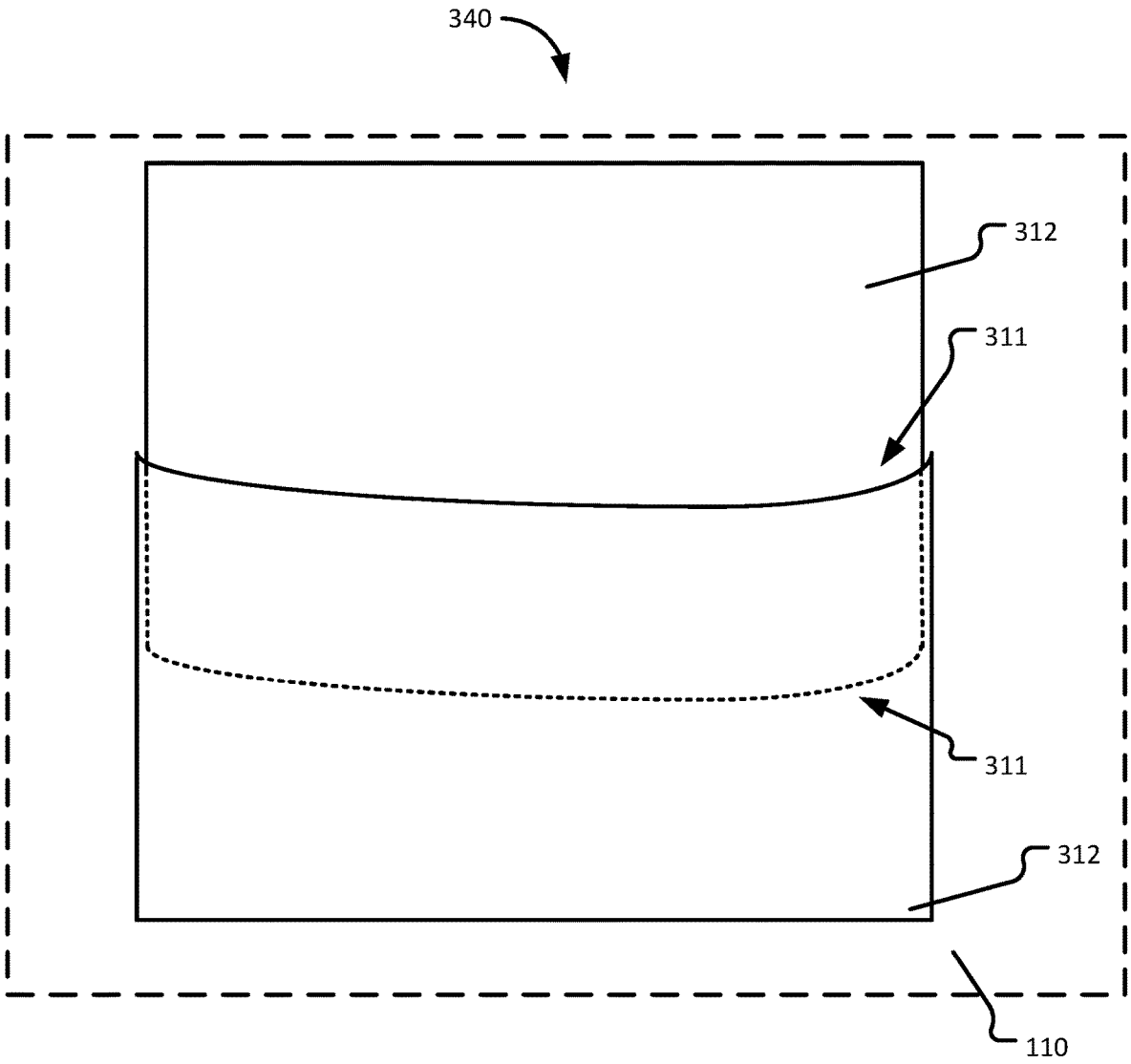

FIG. 3D illustrates an example pocket with overlapped closure 340. The cavity defined by the pocket with overlapped closure 340 is operable to secure mounting hardware within by using two pockets with openings 311 that open into one another and partially overlap one another. Two pocket faces 312 are attached to the curtain body 110, where a portion of each pocket face 312 extends into the opening 311 defined by the other pocket. The portions of the interior pocket face 312 that are within the exterior pocket face 312 are illustrated with dashed lines in FIG. 3D. Although illustrated with vertical openings 311, in other aspects the openings 311 are rotated to open horizontally or any angle between horizontal or vertical.

Figure 4A:
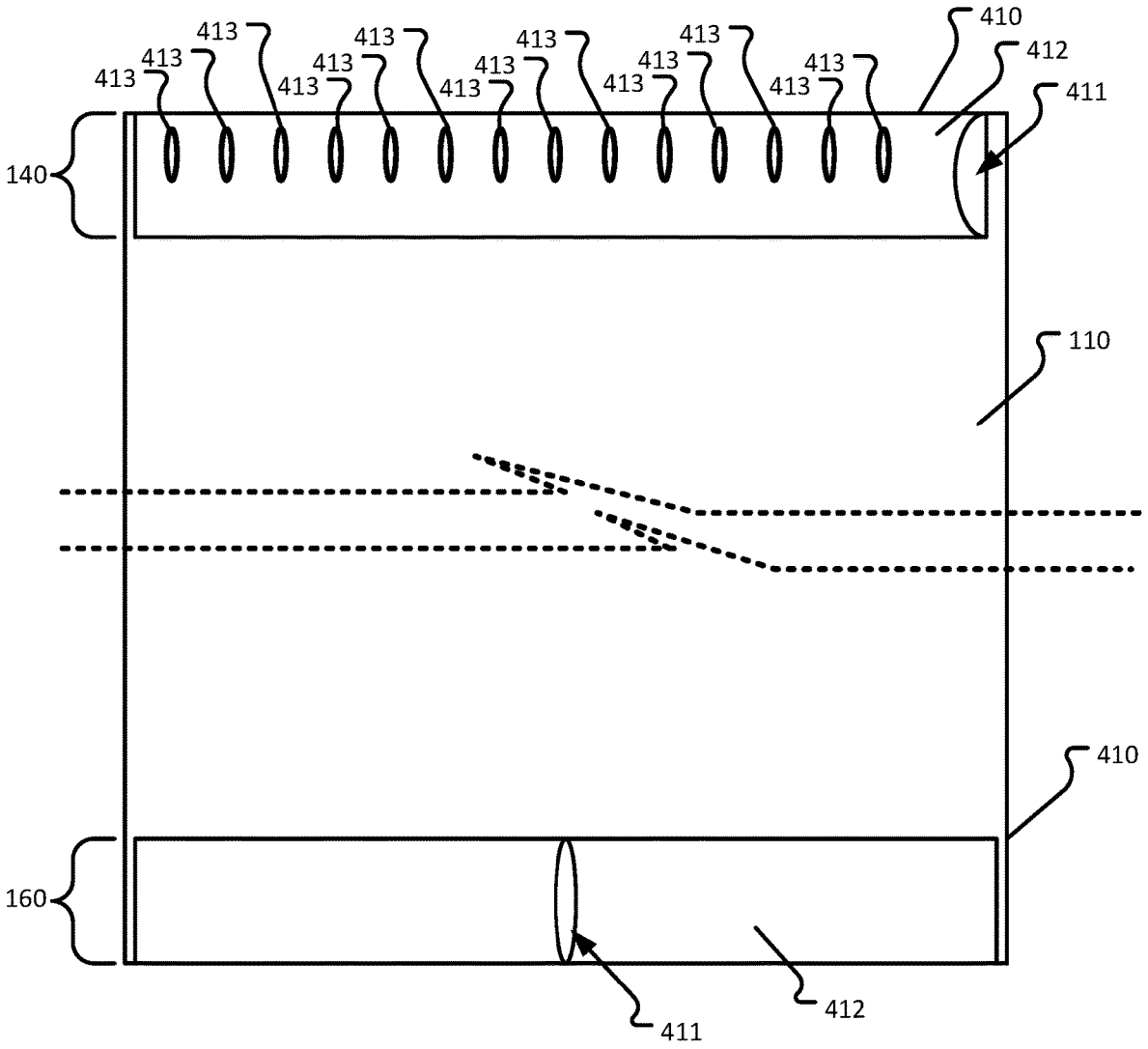
FIGS. 4A-C illustrate examples of continuous hardware integrators.
Figure 4B:
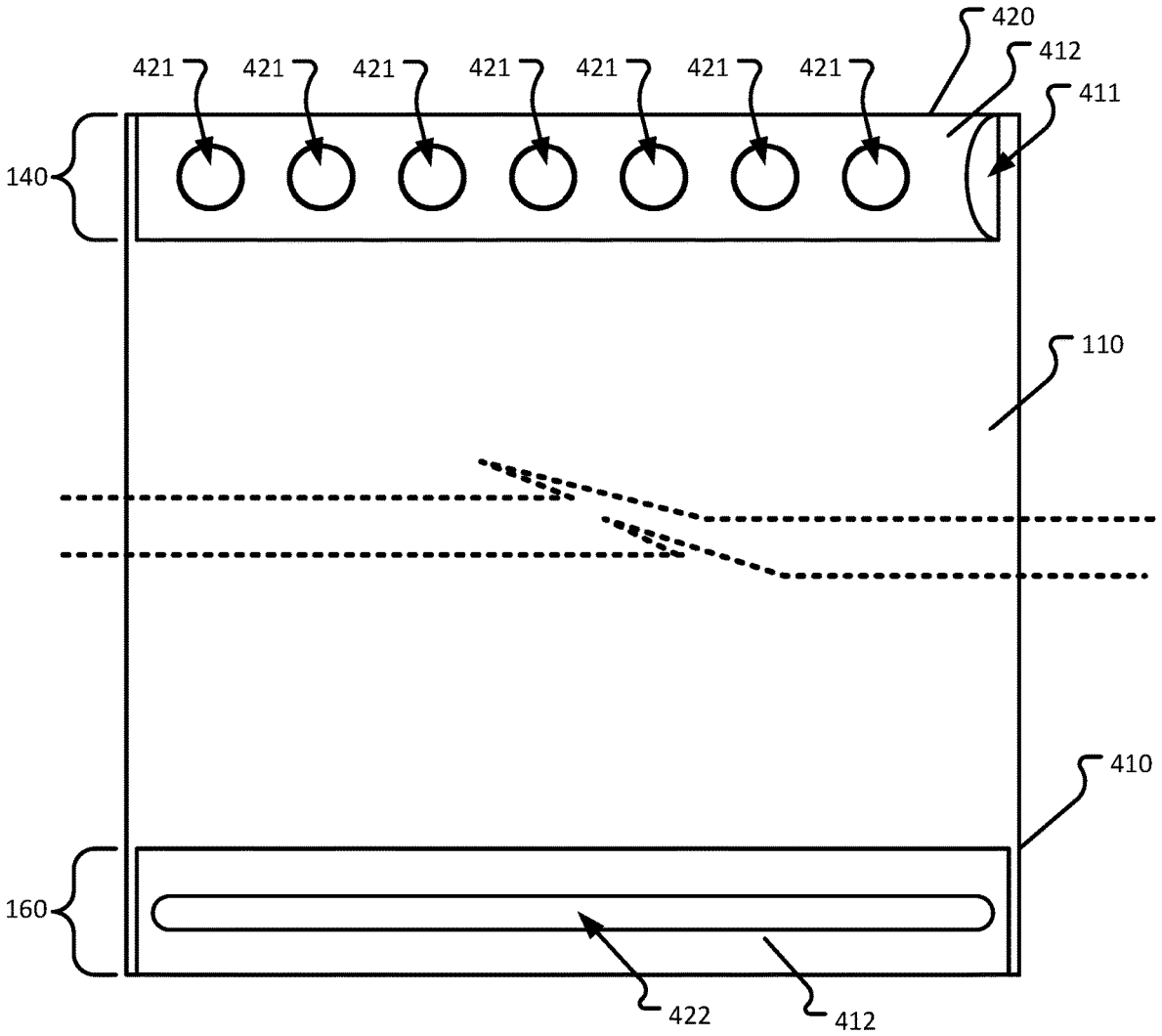
Figure 4C:
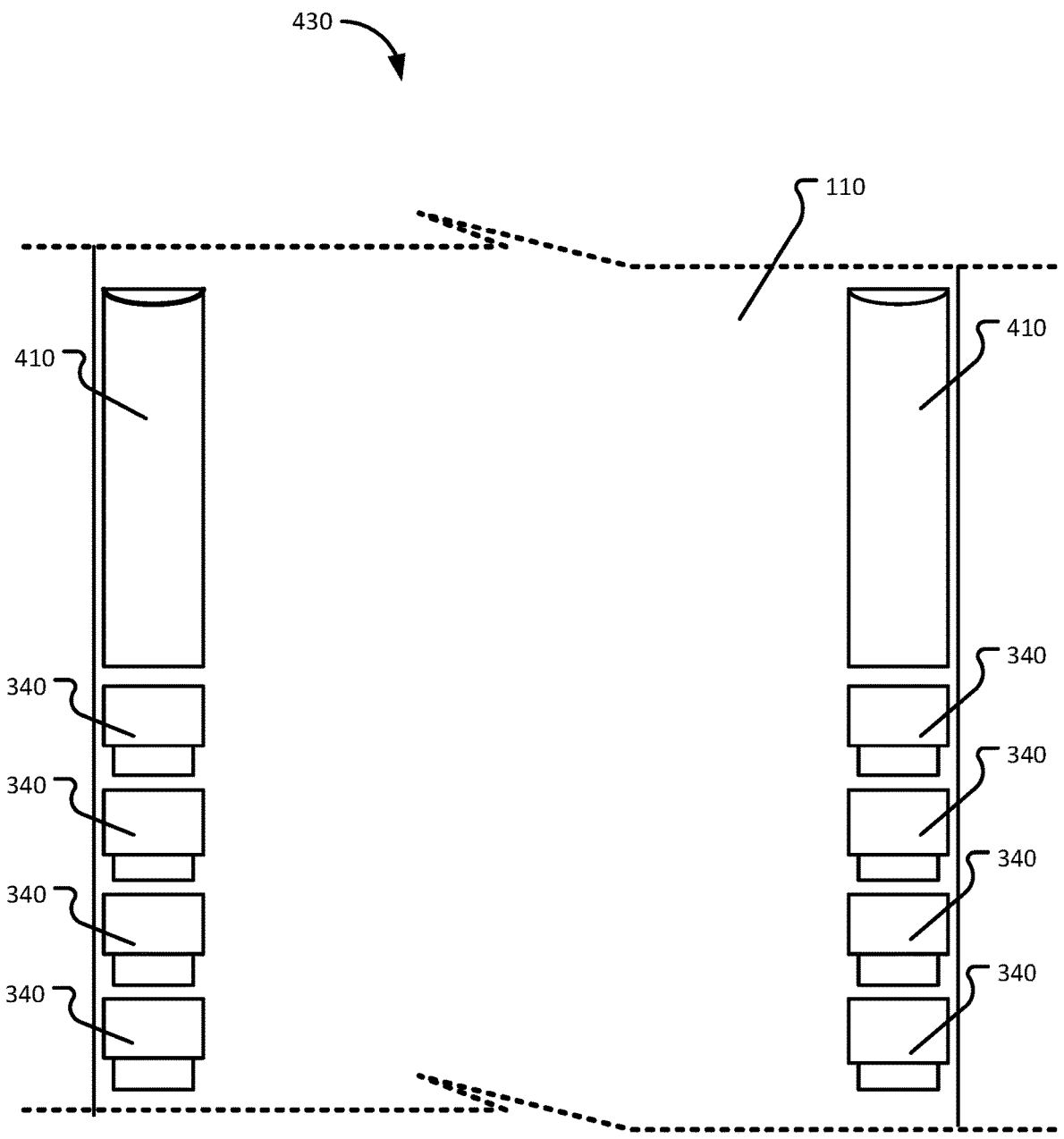

FIGS. 4A-C illustrate various continuous hardware integrators. Unlike the hardware integrators of FIGS. 3A-D, which are mounted on the curtain body 110 with space in between each hardware integrator, allowing for the fabric of the curtain body 110 to be gathered together or allowed to ripple between them, the continuous hardware integrators of FIG. 4A-C provide for the unspaced integration of mounting hardware. One will appreciate that a continuous hardware integrator provides for the integration of mounting hardware over larger lengths and widths of the curtain body 110 at the potential expense of flexibility of the curtain body 110.

The continuous hardware integrators are produced in various aspects by looping the fabric of the curtain body 110 back onto itself and securing that fabric (via stitching, glue, heat bonding, etc.) to the rear of the curtain body 110 to form the continuous hardware integrators. In other aspects, a second piece of fabric (of the same or different material than the curtain body 110) is secured to the rear of the curtain body 110 to form the continuous hardware integrator. For example, a lightweight mesh may be secured to the rear of the curtain system 100 to define various continuous hardware integrators, examples of which are given in regard to FIGS. 4A-C. As will be appreciated, a mesh allows for weight savings as well as allowing some physical contact between a mounting surface and any mounting hardware (e.g., hook-and-loop fasteners, magnets) secured within the continuous hardware integrator and several through holes into which buttons and/or hooks may be inserted into the continuous hardware integrator.

FIG. 4A illustrates two continuous hardware integrators of enclosed tubes 410 running along the width of the curtain body 110 in the top mounting area 140 and the lower mounting area 160. The enclosed tube 410 in the top mounting area 140 defines an opening 411 at one (or more) ends of the tube body 412 by which mounting hardware are selectively inserted or removed. The enclosed tube 410 in the lower mounting area 140 defines one or more openings 411 at an interior portion of the tube body 412 by which mounting hardware are selectively inserted or removed. Although not illustrated, an opening 411 in the tube body 412 may also be defined along the width of the rube body similarly to form an overlapped enclosure similar to that illustrated in FIG. 3D. Various optional button and hook openings 413 are illustrated along the width of the enclosed tubes 410 to enable the enclosed tubes 410 to accept hooks or buttons along their run.

FIG. 4B illustrates two continuous hardware integrators of open tubes 420 running along the width of the curtain body 110 in the top mounting area 140 and the lower mounting area 160. The open tube 420 in the top mounting area 140 defines an opening 411 at one (or more) ends of the tube body 412 by which mounting hardware are selectively inserted or removed and several through holes 421 along its run into which hooks may be accepted or secured mounting hardware (e.g., magnets or hook-and-loop fasteners) may protrude and/or make contact with the mounting surface. The open tube 420 in the lower mounting area 160 defines slit 422 along its run into which buttons or hooks may be accepted or secured mounting hardware (e.g., magnets or hook-and-loop fasteners) may protrude and/or make contact with the mounting surface. In various aspects, an open tube 420 defining a slit 422 may include or exclude openings 411 at its ends. The ratios of the areas defined by the through holes 421 or slits 422 to the area defined by the tube body 412 may differ from that shown in various aspects.

Although illustrated in FIGS. 4A and 4B as running the width of the curtain body 110, in various aspects a horizontal continuous hardware integrator may also run for less than the width of the curtain body 110 (e.g., 30-99%) in either the a top mounting area 140 or a lower mounting area 160. Similarly, a vertical continuous hardware integrator in a side mounting area 150 may run for less than the length of the curtain body 110 (e.g., 30-99%). Stretches of the mounting areas over which the continuous hardware integrators do not run may include hardware integrators as illustrated in FIGS. 3A-D, such as is illustrated in FIG. 3D.

One example hybridization 430 of continuous and non-continuous hardware integrators is shown in FIG. 4C. As illustrated, an upper portion of the side mounting area 150 includes an enclosed tube 410 running for a portion of the length of the curtain body 110, with the remaining lower portion of the side mounting area 150 including several pockets with overlapped closures 340. As will be appreciated, other hybridizations are possible than that illustrated in FIG. 4C, such as, for example, using a continuous hardware integrator in a top mounting area 140 and non-continuous hardware integrators elsewhere, different lengths/ratios of continuous to non-continuous, different locations of hybridization (e.g., along a top mounting area 140), and different choices in continuous and/or non-continuous hardware integrators.

FIGS. 5A-G illustrate various mounting hardware for use with the curtain system 100. In various aspects, a given curtain system 100 uses mounting hardware of one particular type illustrated in FIGS. 5A-G or uses multiple types of mounting hardware. A given curtain system 100 may also be shifted between installation sites and use different mounting hardware at each site. For example, a first curtain system 100 may be installed against a metallic window frame using magnetic fasteners, and then be reinstalled against a wooden door frame using non-magnetic fasteners (e.g., suction cups, tacky putty, glues, buttons).

Figure 5A:
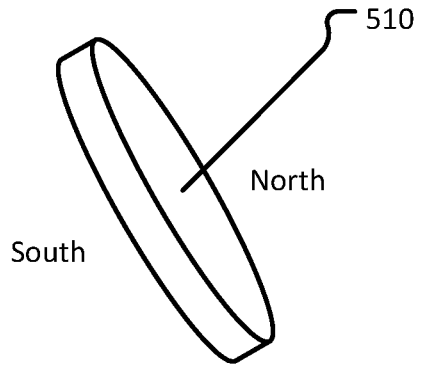
FIGS. 5A-G illustrate examples of mounting hardware.
Figure 5B:
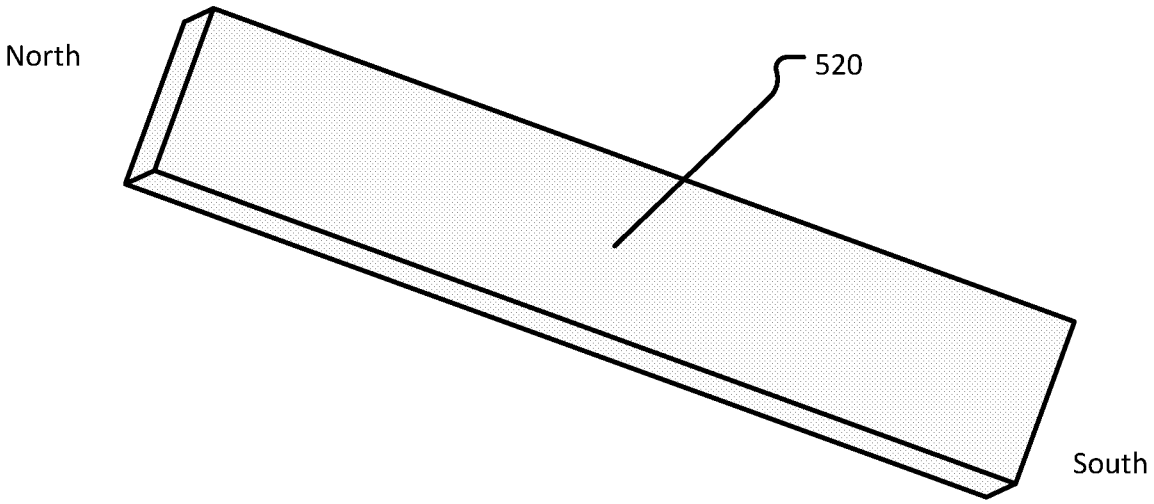

FIG. 5A illustrates a round magnet 510 and FIG. 5B illustrates a bar magnet 520 as example magnets providing magnetic fastening. The dimensions of the magnets are chosen to match the sizes of the hardware integrators into which they are installed. For example, a bar magnet 520 designated for use in a continuous hardware integrator in a top mounting area 140 may have a length, width, and depth to fit through its openings 411 and securely within the continuous hardware integrator across the width of the curtain system 100. In another example, a round magnet designated for used in a pocket hardware integrator may have a radius and a depth to fit through the opening 311 and securely within the pocket. In some aspects, the faces of the magnets that are mounted to (or away from) the mounting surface have opposite polarities, but in other aspects, such as with a bar magnet 520 installed in a continuous hardware integrator, opposing polarities may be present at the distal ends of the magnet.

As will be appreciated, magnets include two poles—a north and a south pole—that are attracted to one another and may be attached to one another or ferrous surfaces via their magnetic forces. In various aspects, the relative strengths of magnets used in the curtain system 100 as mounting hardware may vary depending upon the mounting area in which they are installed. For example, a total magnetic force exerted by one or more magnets in a top mounting area 140 may be greater than the total magnetic force exerted by the one or more magnets in the side mounting areas 150 and lower mounting area 160 to enable a user to pull back or pleat the curtain system 100 with less risk of the curtain system 100 becoming unmounted (e.g., falling off of the surface) or moving from its installed position.

Additionally, the polarity of the magnets used may vary alternate between mounting areas or within mounting areas. For example, a left side mounting area 140 of the curtain body 100 may face the north pole of its magnets to the rear of the curtain system 100, whereas the magnets on the right side mounting area 140 faces the south pole of its magnets to the curtain system 100. In another example, the magnetic facing alternates within a mounting area, such that, for example, the odd numbered magnets face with a first polarity and the even numbered magnets face with a second polarity toward the rear of the curtain system 100. Other patterns of magnetic pole orientations are possible.

Figure 5C:
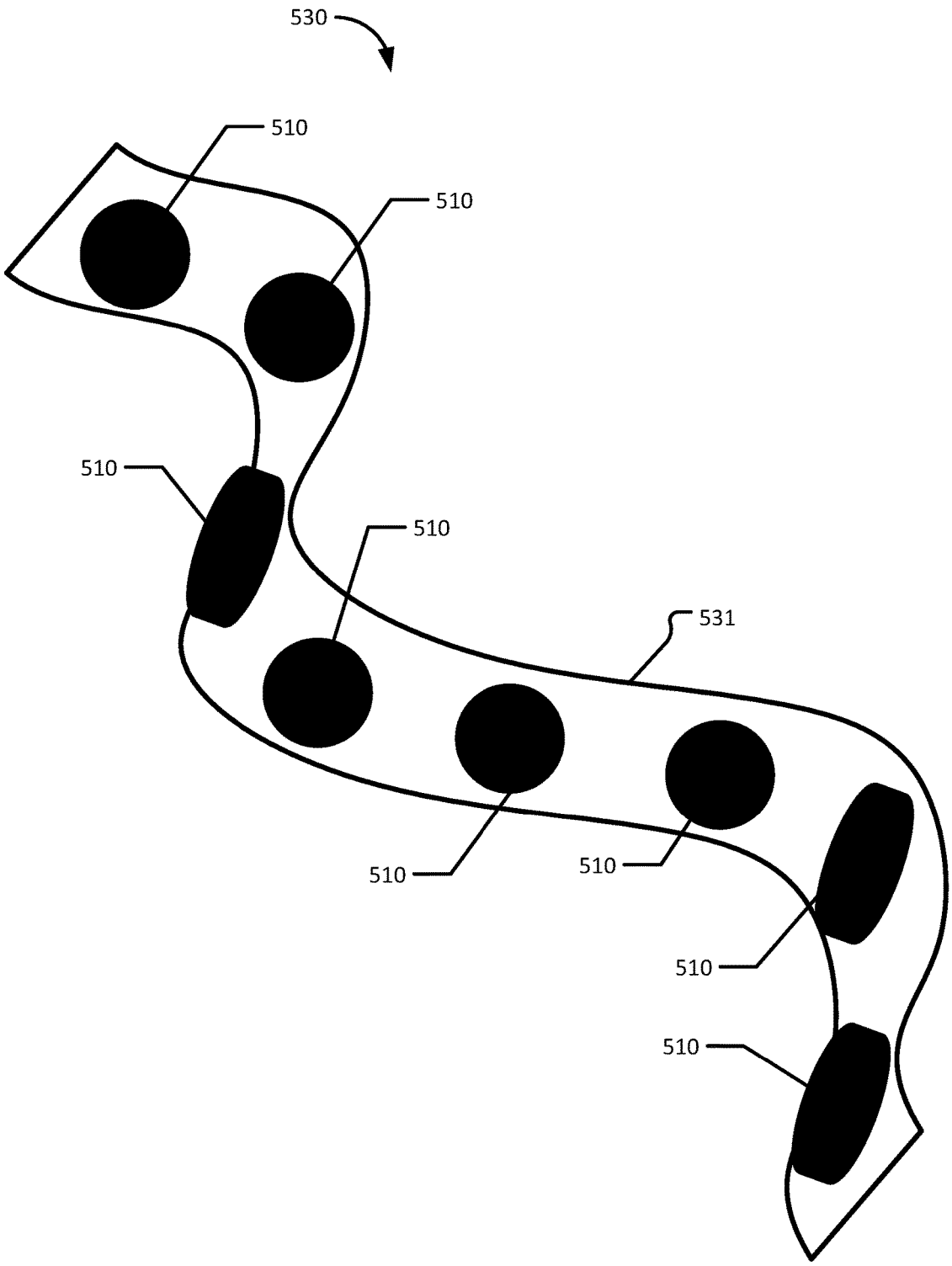

FIG. 5C illustrates a magnetic strip 530, which incorporates several round magnets 510 into a ribbon 531 or other fabric strip. As will be appreciated, bar magnets 520 or other shapes may be used in various other aspects. In various aspects, a magnetic strip 530 incorporates several magnets into a line to replace a similar length of bar magnet 520, to provide greater flexibility between the round magnets 510 than offered by the equivalent length bar magnet 520, and at a lower cost to manufacture.

Figure 5D:
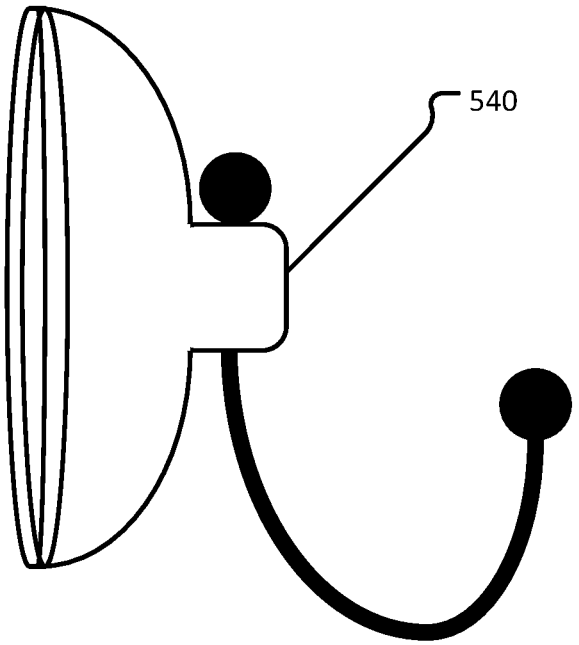
Figure 5E:
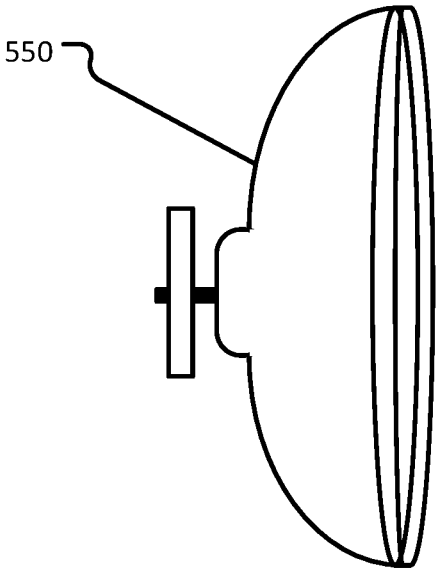

FIGS. 5D and 5E illustrate suction mounting hardware. FIG. 5D illustrates a suction cup with a hook 540 for engaging with holes defined in the hardware integrators (e.g., meshing, through holes, button holes) on the same or different plane of the mounting surface. FIG. 5E illustrates a suction cup with a button 550 for engaging with holes defined in the hardware integrators e.g., meshing, through holes, button holes) on the same plane as the mounting surface. As will be appreciated, a suction cup adheres to a mounting surface via negative fluid pressure and a partial vacuum. The hook or button attached to the suction cup connects the curtain body 110 to the suction cup and holds the curtain system 100 in place. In various aspects, the suction cup may be replaced or augmented via other mounting means in the bowl of the suction cup or around its rim such as, but not limited to, tacky putty, adhesives, caulking, sealing gels, etc.

Figure 5F:
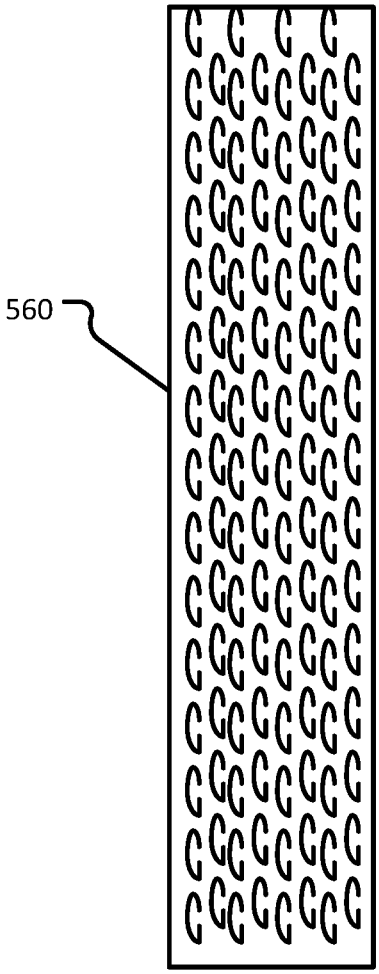
Figure 5G:
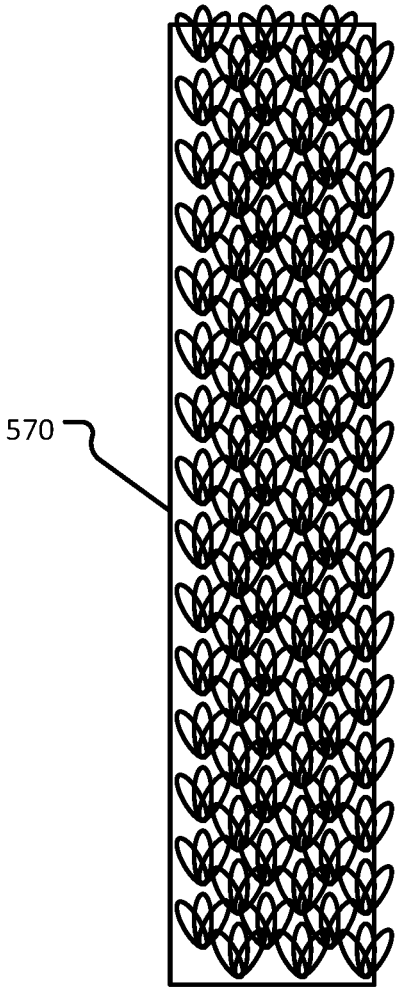

FIGS. 5F and 5G illustrate the two sides or "polarities" of hook-and-loop fasteners. FIG. 5F illustrates the hook-fasteners 560 and FIG. 5G illustrates the loop-fasteners 570. In various aspects, the hook-and-loop fasteners are used in a continuous strip running the length or width of a mounting area, or used in discrete portions of the mounting area. In various aspects, a hook-and-loop fastener is provided within a hardware integrator, with its hooks or loops protruding trough any through holes defined therein, directly to the fabric of the curtain body 110, or on the body of a hardware integrator. In some aspects, a loop-fastener 570 may be omitted, using the fabric of the curtain system 100 as the opposing "polarity" for hook-fasteners 560 included with the curtain system 100.

Figure 6A:
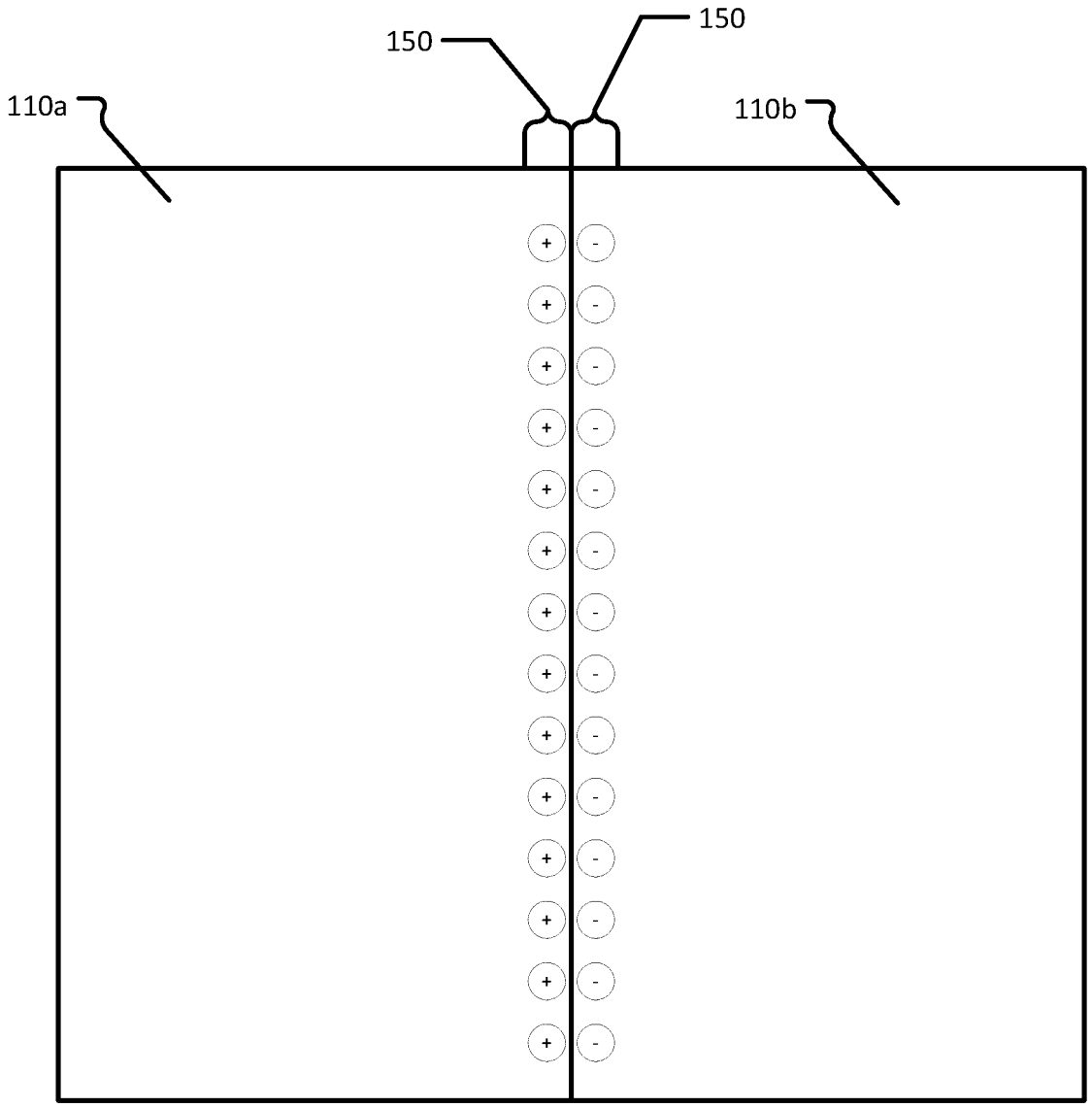
FIGS. 6A-B illustrate two curtain systems interacting via mounting hardware.
Figure 6B:
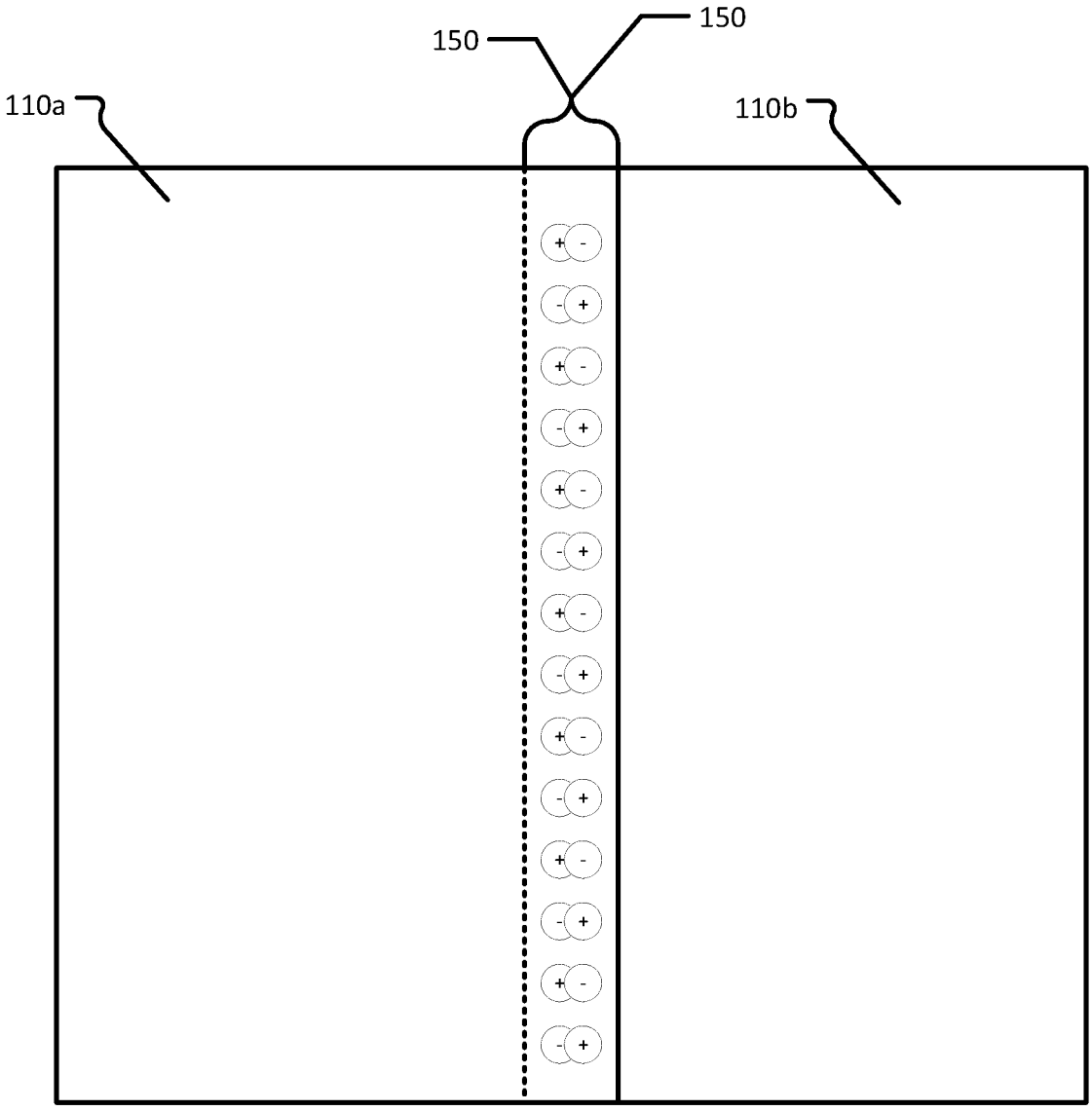

FIGS. 6A and 6B illustrate two curtain systems 100 interacting via their mounting hardware. FIG. 6A illustrates two curtain systems 100 connecting via their side mounting areas 150 without an overlap between the two curtain systems 100, whereas FIG. 6B illustrates an overlap between two interacting curtain systems 100. Multiple curtain systems 100 may be installed in window or door frames, for example, that are larger than a single curtain system 100, or in which a curtain system 100 has been pleated for an aesthetic effect and no longer covers the installed area. In another example, two curtain systems 110 are installed in one window frame, with a first curtain system 100*a* made from a diaphanous material being mounted directly to the frame and the second curtain system 100*b* made from a light-blocking material being mounted to the frame through the first curtain system 100*a*. In a further example, a first waterproof curtain system 100*a* is installed within a shower stall or bathtub and interacts with a second curtain system 100*b* (used for decoration and/or modesty) installed outside of the shower stall or bathtub.

In FIG. 6A, the mounting hardware of a first curtain system 100*a* are able to interact with the mounting hardware of the second curtain system 100*b* when the two curtain systems 100 are side by side—not overlapping. For example, magnets of opposing polarities may be mounted in the side mounting areas 140 of each curtain system 100 to join them when installed. This allows, for example, an even mounting of a surface at a top mounting area 140 to a surface for multiple curtain systems 100 and for any free-hanging side of those curtain systems 100 to be joined together to act as one enlarged curtain system 100.

In FIG. 6B, two curtain systems 100 interact with one another while overlapped. An overlap may include a partial overlap, such as when two side mounting areas 150 (one from each curtain system 100) are overlapped, or a total overlap, such as when one curtain system 100 is mounted over or to another curtain system 100. As illustrated, the outline of the overlapped curtain system 100 is shown with a dotted line. In some aspects the overlapped curtain systems 100 may each be facing the same direction, such that the face of the first curtain system 100*a* interacts with the rear of the second curtain system 100*b*. For example, a rear of a blackout curtain may interact with the face of a sheer curtain to provide a two-layered curtain for the user choose from several options for how much light to let through a window. In other aspects, the rears of each overlapped curtain system 100 may face each other. For example, a two-part shower curtain with a curtain system 100 on the inside and outside of a bathtub will have each curtain system 100 faced rear-to-rear so that the mounting hardware is protected from water by the face of the interior curtain system 100 and the face of the exterior curtain system 100 hides the mounting hardware or hardware integrators from view.

The mounting hardware used to interact between a first curtain system 100 and a second curtain system 100*b* may be different than the mounting hardware used to mount to the surface. For example, with a two-part shower curtain, the two curtain systems 100 may be mounted to a ceiling surface (e.g., via suction hooks interacting with hook holes in the top mounting areas 140) and connect to each other via magnets or hook-and-loop fasteners integrated in side mounting areas 150. In another example, a first curtain system 100 is mounted magnetically to a surface and a second curtain system is mounted via hook fasteners to the face of the first curtain system 100 (acting as or incorporating loop fasteners).

Figure 7A:
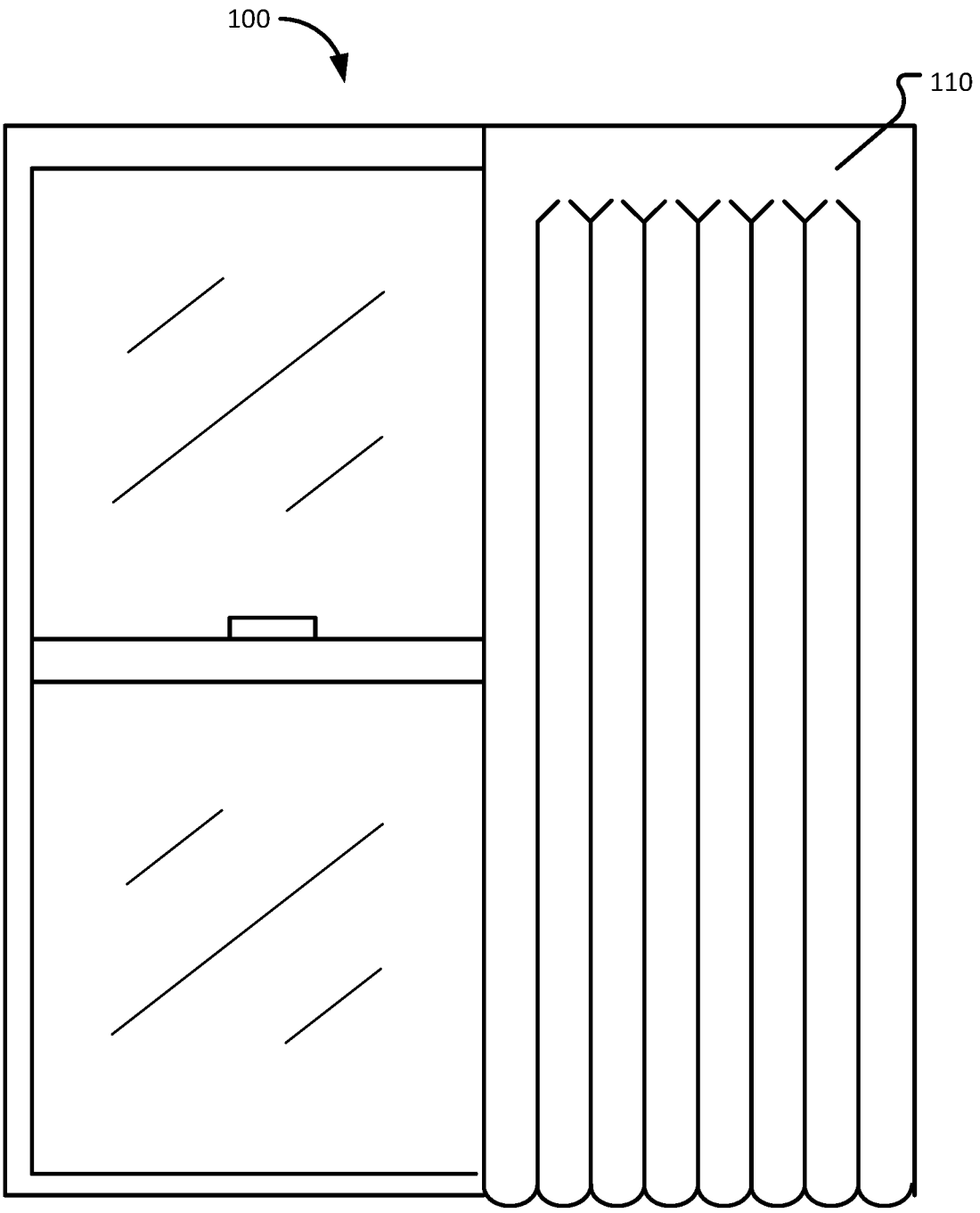
FIGS. 7A-D illustrate various pleatings of the curtain system.
Figure 7B:
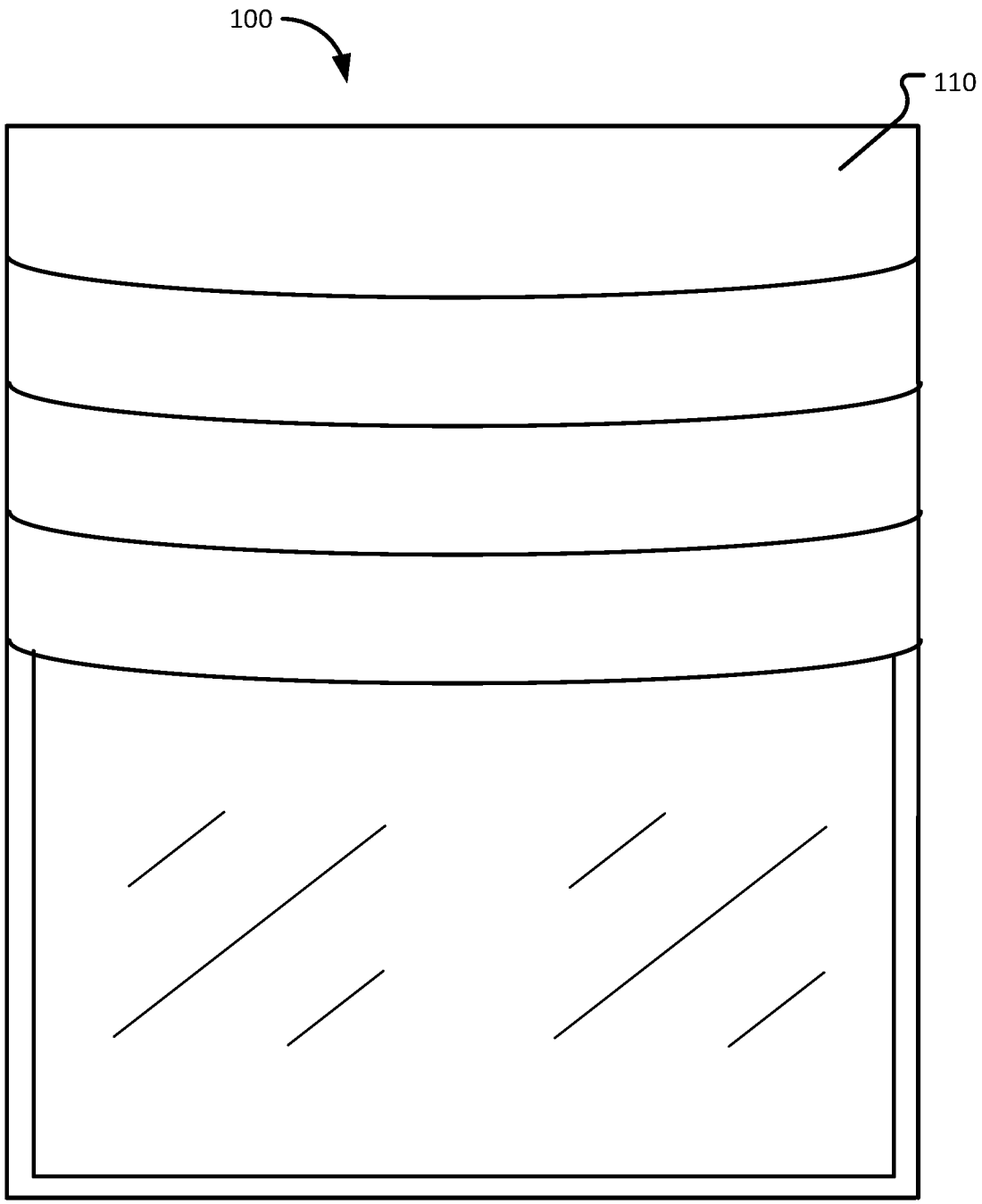
Figure 7C:
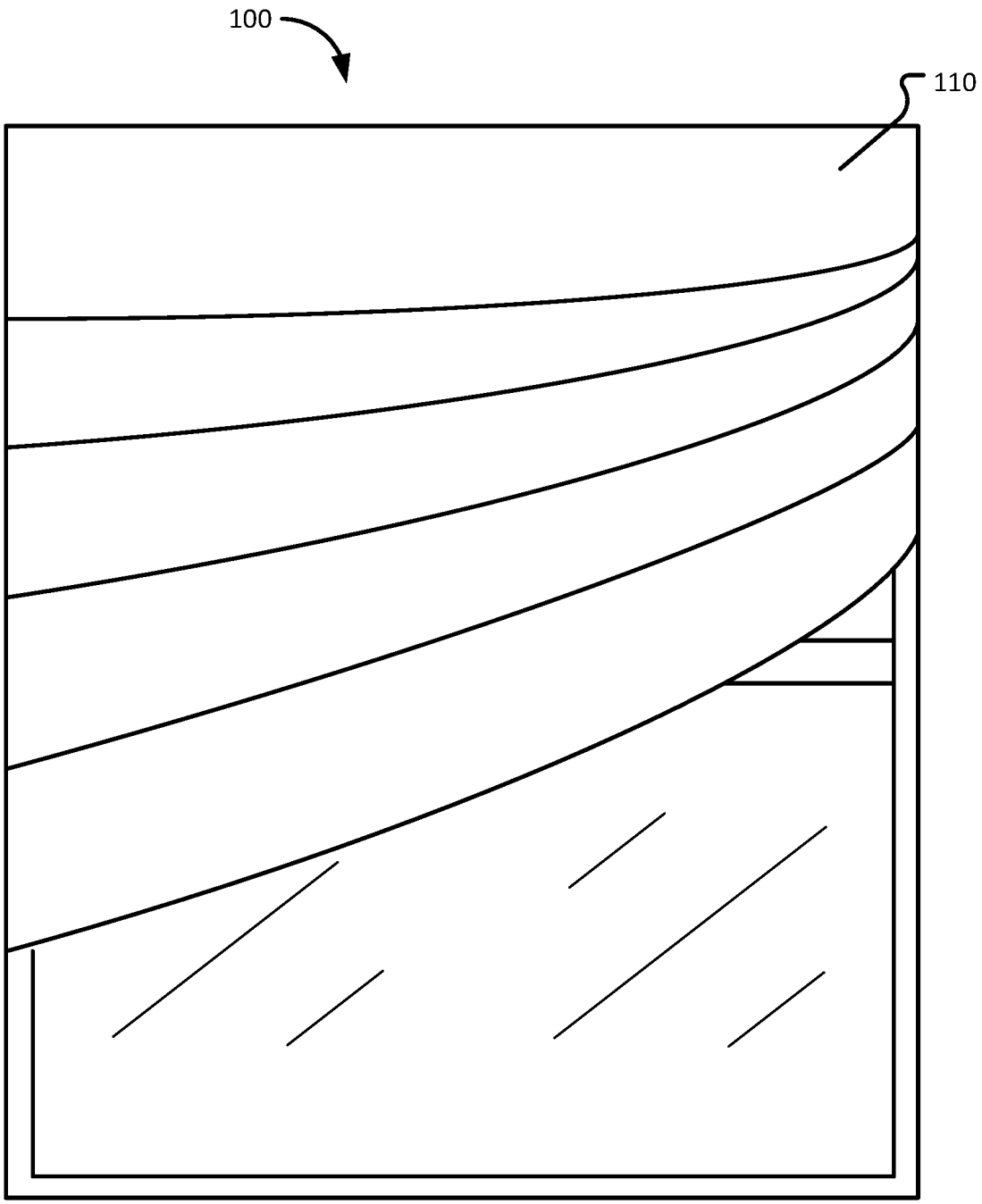

FIGS. 7A-D illustrate various pleatings of the curtain system using the mounting hardware. FIG. 7A illustrates a vertical pleating 710, in which fabric is gathered along the width of the curtain system 100, and FIG. 7B illustrates a horizontal pleating 720, in which fabric is gathered along the length of the curtain system 100. FIG. 7C illustrates a diagonal pleating 730, in which fabric is gathered along the length and width of the curtain system 100. Although illustrated with regular spacing of the pleatings, one of ordinary skill will appreciate that irregular pleatings are also possible, and that a user may apply pleatings across various different sections of the curtain system 100.

A pleating effect is achieved by gathering fabric and letting it project from the mounting surface. In various aspects, the mounting hardware present in the gathered fabric may be removed (as it is no longer in contact with the mounting surface) or allowed to remain in the hardware integrators incorporated into the gathered fabric. In some aspects, where the mounting hardware alternates in polarity, mounting hardware present in the gathered fabric are joined to each other (e.g., a hooked fastener to a looped fastener). By joining the mounting hardware to each other, sharper and more even pleats are formed in the gathered fabric, and when the user wished to unpleat the fabric, the mounting hardware is present to re-mount to the surface.

Figure 7D:
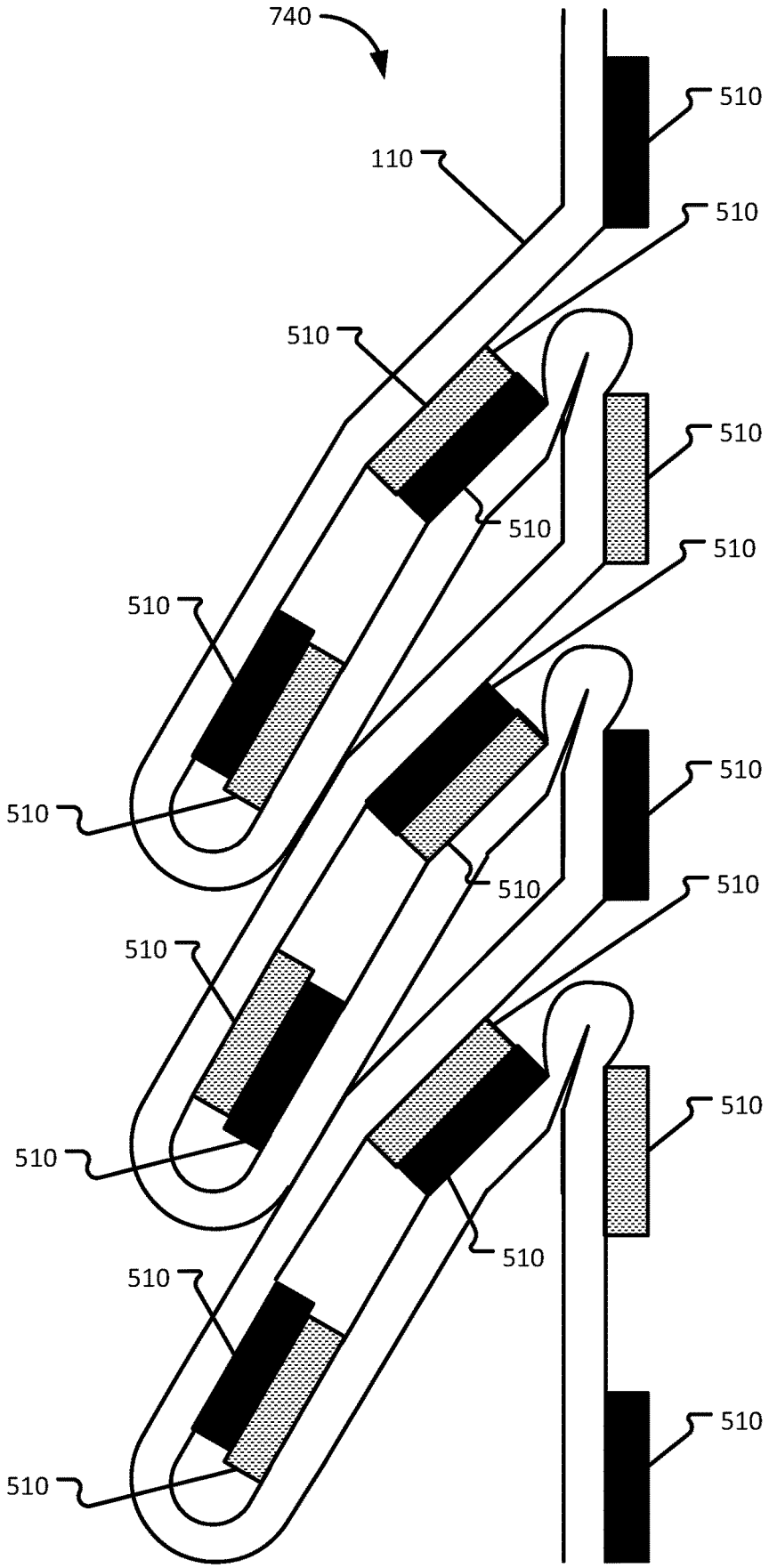

FIG. 7D illustrates a cross-sectional view 740 of the gathered fabric in which the mounting hardware is joined together to form pleats. As illustrated, the fabric of the curtain body 110 is shown in white, the mounting hardware of a first polarity facing (e.g., north/south or hook/loop facing outward from the curtain body 110) is shown in solid black, and the mounting hardware of a second polarity facing (e.g., south/north or loop/hook facing outward from the curtain body 110) is shown with stippling. One of skill in the art will recognize several types of mounting hardware of opposing polarities as discussed herein may be used. The cross-sectional view 740 of FIG. 7D may illustrate a vertical, horizontal, or diagonal pleating, and as will be appreciated, the number of mounting hardware elements in a given pleat may be more or less than illustrated in FIG. 7D.

The mounting hardware elements are mountable to other mounting hardware having the opposing facing, which provides the pleats with strong bonds within and between each pleat. A user may adjust the curtain system 100 to contain various pleats as desired. The regularity and evenness of these pleats depends on the user's selection of various available mounting hardware to mount to one another. As at least some of the mounting hardware are held removably in hardware integrators, the user may freely adjust which mounting hardware elements have a given polarity facing. Additionally, the pleating of the curtain body 110 may be set before or while the curtain system 100 is installed, which will hold during installation without need for sewing the pleat into place.

After having read the above description, one of ordinary skill in the art will appreciate various advantages of the curtain system 100 described herein. The lack of curtain rail, providing for a "rodless" curtain system 100, allows for simpler, safer, and more accessible curtain installation, adjustment, and removal without damage or permanent modification to the mounting surface. The above description is provided for the purposes of illustration and description; it is not intended to be exhaustive or to limit the present disclosure to the precise examples and aspects described. Although certain examples and aspects of the present curtain system are described in the present disclosure, one of ordinary skill in the art will appreciate that other examples and aspects may exist and will be enabled to make modifications and variations in light of the above disclosure. It is intended that the scope of the present disclosure not be limited with the above description, but rather by the claims appended hereto.

What is claimed is:

1. A curtain system, comprising:

a curtain body comprising a length of fabric, the curtain body including a face and a rear opposite to the face in which the rear includes:

an upper hardware integrator disposed of along a width of the curtain system at an upper portion of the curtain body, wherein the upper hardware integrator is an open tube, wherein the open tube defines a series of openings along the width of the curtain body, wherein mounting hardware installed in the upper hardware integrator contact a surface to which the curtain system is mounted via the series of openings;

a first plurality of hardware integrators disposed of along a length of the curtain system at a left edge of the curtain body; and a second plurality of hardware integrators disposed of along the length of the curtain system at a right edge of the curtain body.

2. The curtain system of claim 1, further comprising:

a valance, positioned in front of the face of the curtain body, wherein a length of the valance is less than the length of fabric of the curtain body and wherein a width of the valance is at least as wide as a width of the curtain body.

3. The curtain system of claim 2, wherein:

the valance is connected to the curtain body by a seam running the width of the curtain body.

4. The curtain system of claim 2, wherein:

the valance is connected to the curtain body via a series of pleated loops connected at set intervals to define a series of mounting brackets.

5. The curtain system of claim 1, the rear further including:

additional mounting hardware incorporated with a left edge portion of the curtain body and a right edge portion of the curtain body for mounting the curtain body to the surface.

6. The curtain system of claim 5, wherein the additional mounting hardware incorporated with the left edge portion of the curtain body and the right edge portion of the curtain body are a lower strength than the mounting hardware incorporated with the upper portion of the curtain body.

7. The curtain system of claim 5, wherein the additional mounting hardware incorporated with the left edge portion of the curtain body has a first polarity and the additional mounting hardware incorporated with the right edge portion of the curtain body has a second polarity opposite to the first polarity.

8. The curtain system of claim 5, wherein the additional mounting hardware incorporated with the left edge portion alternate between hook-style fasteners and loop-style fasteners along the length of the curtain body and the additional mounting hardware incorporated with the right edge portion of the curtain body alternate between hook-style fasteners and loop-style fasteners along the length of the curtain body.

9. The curtain system of claim 1, the rear further including:

additional mounting hardware incorporated with a lower portion of the curtain body for mounting the curtain body to the surface.

10. The curtain system of claim 1, wherein the mounting hardware is selected from the group comprising:

magnets;

hook fasteners;

loop fasteners;

hook mounted suction cups; and button mounted suction cups.

11. The curtain system of claim 9, further comprising:

a free hanging section below the curtain body, the free hanging section excluding the mounting hardware and the additional mounting hardware.

12. The curtain system of claim 1, wherein the mounting hardware are selectively removable and reinstallable with the curtain body.

13. A curtain system, comprising:

a curtain body having a rear including:

an upper hardware integrator disposed of along a width of the curtain system at an upper portion of the curtain body;

a first plurality of hardware integrators disposed of along a length of the curtain system at a left edge of the curtain body; and a second plurality of hardware integrators disposed of along the length of the curtain system at a right edge of the curtain body, wherein hardware integrators of the first plurality of hardware integrators and of the second plurality of hardware integrators each define a cavity via a pocket face connected to the curtain body to thereby define an opening to accept and secure mounting hardware within the cavity.

14. The curtain system of claim 13, wherein the rear of the curtain body further includes:

a lower hardware integrator disposed of along the width of the curtain system at a lower portion of the curtain body; and wherein the curtain system further comprises a free hanging section disposed of below the lower hardware integrator.

15. The curtain system of claim 13, wherein mounting hardware included in the hardware integrators of the first plurality of hardware integrators have a first polarity facing and mounting hardware included in the hardware integrators of the second plurality of hardware integrators have a second polarity facing.

16. The curtain system of claim 13, wherein mounting hardware included in the hardware integrators of the first plurality of hardware integrators and the second plurality of hardware integrators alternate between a first polarity facing and a second polarity facing.

17. The curtain system of claim 13, wherein the pocket face is comprised of a mesh fabric.

18. A curtain system, comprising:

a curtain body, comprising a length and a width, having a front face and a rear face;

a valance, comprising the width of the curtain body and a length no more than the length of the curtain body, connected to the curtain body at an upper edge of the curtain body via a seam; and a free-hanging section, comprising the width of the curtain body, extending from a lower edge of the curtain body;

wherein the front face includes a mounting bracket positioned on the upper edge of the curtain body defining a pocket between the front face and the valance, the pocket defining an opening facing away from the seam; and wherein the rear face includes:

a first continuous hardware integrator disposed of along the width of the curtain body at the upper edge;

a first plurality of pocket hardware integrators disposed of along the length of the curtain body at a left edge of the curtain body;

a second plurality of pocket hardware integrators disposed of along the length of the curtain body at a right edge of the curtain body; and a second continuous hardware integrator disposed of along the width of the curtain body at the lower edge.

* * * * *